US010648296B2

(12) United States Patent
du Castel et al.

(10) Patent No.: US 10,648,296 B2
(45) Date of Patent: May 12, 2020

(54) BOREHOLE CASING DEPLOYMENT DETECTION

(71) Applicant: Schlumberger Technology Corporation, Sugar Land, TX (US)

(72) Inventors: Bertrand du Castel, Austin, TX (US); John Christian Luppens, Houston, TX (US); James Curtis Brannigan, Cypress, TX (US); Oney Erge, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 293 days.

(21) Appl. No.: 15/518,612

(22) PCT Filed: Oct. 14, 2015

(86) PCT No.: PCT/US2015/055439

§ 371 (c)(1),
(2) Date: Apr. 12, 2017

(87) PCT Pub. No.: WO2016/061171

PCT Pub. Date: Apr. 21, 2016

(65) Prior Publication Data

US 2017/0234114 A1 Aug. 17, 2017

Related U.S. Application Data

(60) Provisional application No. 62/064,237, filed on Oct. 15, 2014.

(51) Int. Cl.

| | |
|---|---|
| ***E21B 43/10*** | (2006.01) |
| ***E21B 41/00*** | (2006.01) |
| ***E21B 47/00*** | (2012.01) |

(52) U.S. Cl.
CPC ..... *E21B 43/10* (2013.01); *E21B 41/0092* (2013.01); *E21B 47/00* (2013.01)

(58) Field of Classification Search
CPC ..... E21B 41/0092; E21B 43/10; E21B 47/00
See application file for complete search history.

(56) References Cited

U.S. PATENT DOCUMENTS

| | | | |
|---|---|---|---|
| 6,174,001 | B1 | 1/2001 | Enderle |
| 8,606,734 | B2 | 12/2013 | Du Castel et al. |

(Continued)

FOREIGN PATENT DOCUMENTS

| | | | |
|---|---|---|---|
| EP | 2607621 | A1 | 6/2013 |
| WO | 2010010453 | A2 | 1/2010 |

OTHER PUBLICATIONS

International Search Report and Written Opinion issued in corresponding International Application PCT/US2015/055439 dated Mar. 22, 2016. 20 pages.

(Continued)

*Primary Examiner* — Caroline N Butcher
(74) *Attorney, Agent, or Firm* — Alec J. McGinn

(57) ABSTRACT

A casing deployment apparatus includes a processing resource with a signal pattern recognition engine unit (420), a tubular measurement unit (404) and a decision unit (416). A first sensor input (402) and a second sensor input (406) are attached to the pattern recognition unit (420) and receive first sensor data and second sensor data corresponding to first and second time-varying sensor signals. The pattern recognition unit (420) analyzes a characteristic of the first sensor data to determine whether the characteristic is substantially consistent with a first expected characteristic of the first sensor data associated with deployment of casing in a borehole. The tubular measurement unit (404) analyzes a characteristic of the second sensor data in order to determine whether the characteristic is substantially consistent with a (Continued)

second expected characteristic of the second sensor data associated with the deployment of the casing.

24 Claims, 13 Drawing Sheets

(56) References Cited

U.S. PATENT DOCUMENTS

| | | | | |
|---|---|---|---|---|
| 2004/0246816 | A1 | 12/2004 | Ogle | |
| 2007/0089878 | A1* | 4/2007 | Newman | E21B 19/166 166/255.1 |
| 2010/0124096 | A1 | 5/2010 | Oyasato et al. | |
| 2010/0332137 | A1 | 12/2010 | Meadows et al. | |
| 2013/0124096 | A1* | 5/2013 | Du Castel | E21B 47/00 702/9 |
| 2014/0096956 | A1 | 4/2014 | Willauer | |
| 2014/0191879 | A1 | 7/2014 | Bittar et al. | |

OTHER PUBLICATIONS

Iversen et al., Offshore Field Test of a New Integrated System for Real-Time Optimisation of the Drilling Process. IADC/SPE 112744. IADC/SPE Drilling Conference. Mar. 4-6, 2008. Orlando, Florida. 15 pages.

* cited by examiner

BOREHOLE CASING DEPLOYMENT DETECTION

BACKGROUND

Embodiments of the present disclosure relate to a method of identifying deployment of a casing in a borehole, the method being of the type that processes sensor measurements to determine casing deployment. The present disclosure also relates to a casing deployment detection apparatus of the type that, for example, is configured to receive and process sensor data to determine casing deployment characteristics. The present disclosure also relates to a method of identifying cementing of a borehole, the method being of the type that, for example, processes sensor measurements to determine characteristics of the cementing. The present disclosure further relates to a cementing detection apparatus of the type that, for example, is arranged to receive an process sensor data regarding the cementing.

In the hydrocarbon extraction industry, during the course of a drilling program, the borehole typically has one or more "casing strings" run and cemented in place. A typical drilling program first involves drilling a large diameter borehole from the Earth's surface for several thousand feet. A "surface casing" string is then run into the borehole and cement is then pumped inside the casing and returns up through an annulus located between the casing and the borehole. After the cement in the annulus has cured or hardened, another drill bit is utilized to drill through the cement in the surface casing to drill a second and deeper borehole into the formations of the Earth. Typically, the subsequent drill bit has a smaller diameter than the initial drill bit such that the second borehole has a smaller diameter than the diameter of the surface borehole.

At an appropriate depth below the surface casing, the drilling of the borehole is discontinued and a string of pipe commonly called a casing or liner is inserted through the surface casing.

Again, cement is pumped inside the casing and returns up through the annulus, where it cures or hardens. When the cementing operation is completed and the cement sets, there is a column of cement in the annulus of the subsequent string of pipe. The casing strings are usually comprised of a number of joints, each being on the order of forty feet long, connected to one another by threaded connections or other connection means.

Casing the well aims to serve dual purposes: preventing the bore walls from collapsing and isolating the various geological strata and thus, avoiding exchange of fluids between them.

In the oilfield industry, there is a need to automate process and/or applications and to monitor the automated processes and applications. In particular, it is desirable to monitor certain oilfield activities either in real-time or monitoring data stored in a post-processing context. In this regard, casing and cementing are borehole activities that are expensive and time consuming. When conducting real-time analysis, failure to recognize that casing is in progress can delay the ordering of cementing capabilities and cause days. Sometimes such a failure can immobilize a drilling rig for weeks, negating any gains in drilling time otherwise made, for example by rate of penetration optimization.

Also, there is a growing desire in the oilfield industry to automate the drilling cycle: from the so-called "spud" to completion of a well. Automatic interpretation of drilling surface signals, signals made by measurement devices at the surface, therefore becomes a pre-requisite for this automation. In this respect, without proper detection of casing runs, automatic control cannot take place, because for example casing runs risk being confused with so-called "trips in", and the bottom of a casing run risks being interpreted as a drill bit passing through and reaching the end of a run of casing ready to operate in an open hole below the casing. In an automated environment, such misinterpretations of the available data can trigger the execution of incorrect operations, which has the potential to cause great damage to the well being drilled and/or equipment associated with drilling the well.

Furthermore, accurate detection of a cementing stage allows events, categorized as "non-drilling" events (events that do not involve running a drillstring or casing down a borehole), to be detected. This, in turn, allows the time spent on those activities to be evaluated and so allows for optimization of the drilling process through comparison of performance between many jobs. Therefore, proper casing and/or cementing detection allows best practice management of "non-drilling" activities.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

According to a first aspect of an embodiment of the present disclosure, there is provided a method of identifying deployment of casing in a borehole. The method includes using a plurality of sensors or a sensor network to make measurements in the borehole, at a surface side of the borehole and/or of equipment deployed in or at a surface side of the borehole. Data in the form of a time-varying sensor signal is received from a first sensor and a second sensor; and a characteristic of the first sensor data and a characteristic of the second sensor data is analyzed to determine whether the respective characteristics of the analyzed first and second sensor data are respectively substantially consistent with a first expected characteristic of the first sensor data and a second expected characteristic of the second sensor data associated with deployment of casing in a borehole.

The method may further comprise: generating the first time-varying sensor signal surface-side; and generating the second time-varying sensor signal surface-side. The method may further comprise: identifying a correlation between the characteristic of the first sensor data and the first expected characteristic of the first sensor data; and determining whether the second sensor data comprises a characteristic quantifiably substantially the same as the second expected characteristic of the second sensor data.

The first expected characteristic of the first sensor data and the second expected characteristic of the second sensor data may together substantially characterize the deployment of the casing in the borehole.

The first sensor data may comprise hookload data. The second sensor data may comprises block position data.

The method may further comprise: identifying a candidate casing time window corresponding to the determined deployment of the casing in the borehole.

The method may further comprise: analyzing the second sensor data in respect of the candidate casing time window in order to measure a length of a tubular element being inserted in the borehole; and determining whether the length of the tubular element corresponds to a known length of a standard casing tubular.

The method may further comprise: analyzing the first sensor data in respect of the candidate casing time window in order to identify a predetermined repeating pattern constituting the first expected characteristic of the first sensor data.

The repeating pattern may comprise an increasing magnitude between repeats. The repeating pattern may comprise a predetermined number of repeats.

The method may further comprise: using the first sensor data to determine a weight of a tubular element contributing to the repeating pattern; and modifying the predetermined number of repeats in response to the weight of the tubular corresponding to a known weight of the standard casing tubular.

The method may further comprise: receiving third sensor data corresponding to a third time-varying sensor signal; using the third sensor data in respect of the candidate casing time window to increase confidence in the determination of the deployment of the casing in the borehole.

The third sensor data may comprises magnitude data; the method may further comprise: evaluating a magnitude of the magnitude data with respect to a predetermined reference magnitude value.

The third sensor data may comprise torque data.

The method may further comprise: recording parameters of the candidate casing time window.

The evaluation of the magnitude of the magnitude data may determine whether the magnitude is less than the predetermined reference value.

The method may further comprise: recording parameters of the candidate casing time window for further analysis in response to the evaluation of the magnitude being indicative of the deployment of the casing in the borehole during the candidate casing time window.

The method may further comprise: receiving fourth sensor data; identifying a pattern described by the first, third and fourth sensor data in the candidate casing time window indicative of an inserted casing overcoming an obstruction in the borehole.

The fourth data stream may comprise pressure data.

The method may further comprise: analyzing the first and/or the second and/or a third and/or a fourth sensor signal in respect of the candidate casing time window in order to identify an indicator in the first, second, third and/or fourth sensor signals indicative of the candidate casing deployment being a deployment of a casing in the borehole in fact.

The method may further comprise: identifying time periods when slips events are employed; and analyzing the second sensor data in respect of the candidate casing time window in order to identify the indicator, the indicator comprising insertion of at least a predetermined number of tubulars into the borehole without off-slips events therebetween.

The method may further comprise: receiving fourth sensor data; analyzing the fourth sensor data in respect of the candidate casing time window in order to identify another indicator that the casing has in fact been deployed in the borehole.

The method may further comprise: scanning a predetermined time range before an end of the candidate casing time window; and evaluating the first sensor data in respect of the predetermined time range with respect to a predetermined value.

The first sensor data may be hookload data and the predetermined value may be a predetermined hookload value; and the evaluation of the first sensor data with respect to the predetermined value may be a determination of a hookload exceeding the predetermined hookload value.

The method may further comprise: deselecting the candidate casing time window as a candidate in response to an unwanted result of the evaluation of the first sensor data with respect to the predetermined value.

The method may further comprise: analyzing the first sensor data in respect of the candidate casing time window in order to identify a predetermined pattern of hookload and pressure indicative of a drillstring passing through casing into an uncased region of the borehole followed by commencement of drilling.

The method may further comprise: analyzing the first and fourth sensor data in respect of the candidate casing time window in order to identify: a cycle of increasing hookloads; a subsequent increase in the hookload and pressure indicative of the drillstring entering the uncased region of the borehole; and a subsequent reduction in the hookload and the pressure indicative of the commencement of the drilling.

The method may further comprise: deselecting the candidate casing time window as a candidate in response to identifying the predetermined pattern of hookload and pressure indicative of the drillstring passing through the casing into the uncased region of the borehole followed by the commencement of drilling.

The method may further comprise: analyzing a preceding time range immediately before the candidate casing time window in order to determine whether during the preceding time range a tubular corresponding to a drillstring is at the surface.

The method may further comprise: analyzing the first sensor data in respect of an initial time region of the candidate casing time window in order to determine whether the first sensor data within the initial time region comprises a hookload pattern indicative of an initiation of deployment of casing.

The method may further comprise: analyzing the candidate casing time window in order to determine whether a casing string comprises a plurality of tubulars of consistent length.

The method may further comprise: analyzing the first sensor data in respect of the candidate casing time window in order to determine a first hookload in respect of tripping in a run of tubular and a second hookload in respect of tripping out; and determining whether the first hookload is different to the second hookload by at least a predetermined hookload difference.

The method may further comprise: analyzing the first and third sensor data in respect of the candidate casing time window in order to identify a pattern of hookload and torque or rotation indicative of deposition of a borehole liner.

According to a second aspect of an embodiment of the present disclosure, there is provided a method of identifying cementing of a borehole, the method comprising: identifying deployment of casing in a borehole in accordance with the first aspect of the invention; identifying a casing time window associated with the identified deployment of the casing in the borehole; identifying an end of the casing time window; setting a forward analysis time point at or after the end of the casing time window.

The method may further comprise: analyzing the second sensor data in order to detect whether a plurality of tubulars are inserted into the borehole; counting a number of tubulars inserted into the borehole in response to detection of the insertion of the plurality of tubulars; and counting a number of tubulars removed from the borehole after the insertion of the plurality of tubulars into the borehole.

The method may further comprise: determining whether the number of tubulars inserted into the borehole is substantially the same as the number of tubulars removed from the borehole thereafter; and advancing the forward analysis time point to a time corresponding to an end of the removal of the tubulars from the borehole.

The method may further comprise: analyzing the second sensor data in order to determine whether tubular movement is absent within a predetermined preliminary time range from the forward analysis time point.

The method may further comprise: receiving pressure sensor data; analyzing the pressure sensor data to identify a pattern of application of pressure over a predetermined testing period of time, the predetermined testing period of time corresponding to a duration of a cementing operation.

The predetermined testing period of time may be at least about ten hours in duration.

The method may further comprise: recording the forward analysis time point as indicative of a commencement of a cementing operation.

The method may further comprise: analyzing the pressure sensor data in order to detect a pressure pattern indicative of an end of a cementing operation.

The method may further comprise: analyzing the first sensor data and/or the second sensor data and determining whether the first sensor data and/or the second sensor data comprises a period of inactivity following the detected end of the cementing operation that is greater than a predetermined inactivity time period.

The method may further comprising: analyzing the first sensor data and/or the second sensor data in order to determine whether activity following the predetermined inactivity time period is an activity that should not follow the cementing operation.

The method may further comprise: recording a point in time immediately preceding the detected activity in response to the activity being detected as an activity that is expected to follow the cementing operation, the point in time being recorded as indicative of an end of the cementing operation.

The method may further comprise: analyzing the pressure sensor data in order to determine a period of inactivity indicative of a period of time during which cementing resources are awaited.

According to a third aspect of an embodiment of the present disclosure, there is provided a computer program element comprising computer program code means to make a computer execute the method as set forth above in accordance with the first aspect of the invention.

The computer program element may be embodied on a computer readable medium.

According to a fourth aspect of an embodiment of the present disclosure, there is provided a casing deployment detection apparatus comprising: a plurality of sensors and/or a sensor network deployed within the borehole and/or at a top-side location of the borehole. In some embodiments, the sensors/sensor network measure properties of equipment deployed in and/or at a top-side location of the borehole. The sensors may measure properties in the borehole, at the top-side location and/or of the equipment deployed in and/or at a top-side location of the borehole. The sensors/sensor network communicates with a processing resource arranged to support a signal pattern recognition engine unit and a block position calculation unit. A first sensor input operably coupled to the signal pattern recognition engine unit and arranged to receive, when in use, first sensor data corresponding to a first time-varying sensor signal; a second sensor input operably coupled to the tubular measurement unit and arranged to receive, when in use, second sensor data corresponding to a second time-varying sensor signal; wherein the signal pattern recognition engine unit is arranged to analyze a characteristic of the first sensor data in order to determine whether the characteristic of the first sensor data is substantially consistent with a first expected characteristic of the first sensor data associated with deployment of casing in a borehole; and the block position calculation unit is arranged to analyze a characteristic of the second sensor data in order to determine whether the characteristic of the second sensor data is substantially consistent with a second expected characteristic of the second sensor data associated with the deployment of the casing in the borehole.

The processing resource may be arranged to support a decision unit operably coupled to the signal pattern recognition engine unit and the block position calculation unit; and the decision unit may comprise logic arranged to verify both the first characteristic of the first sensor signal is substantially consistent with the expected characteristic of the first sensor signal and the second characteristic of the second sensor signal is substantially consistent with the expected second characteristic of the second sensor signal.

The first expected characteristic of the first sensor data and the second expected characteristic of the second sensor data may together substantially characterize the deployment of the casing in the borehole.

The signal pattern recognition engine unit may be arranged to identifying a first correlation between the characteristic of the first sensor data and the first expected characteristic of the first sensor data.

The processing resource may be arranged to identify a candidate casing time window corresponding to the determined deployment of the casing in the borehole.

The block position calculation unit may be arranged to analyze the second sensor data in respect of the candidate casing time window in order to measure a length of a tubular element being inserted in the borehole; and the block position calculation unit may also be arranged to determine whether the length of the tubular element corresponds to a known length of a standard casing tubular.

The signal pattern recognition engine unit may be arranged to analyze the first sensor data in respect of the candidate casing time window in order to identify a predetermined repeating pattern constituting the first expected characteristic of the first sensor data.

The repeating pattern may comprise an increasing magnitude between repeats. The repeating pattern may comprise a predetermined number of repeats.

The processing resource may be arranged to support a hookload calculation unit; the hookload calculation unit may be arranged to receive the first sensor data and to determine a weight of a tubular element contributing to the repeating pattern; and the signal pattern recognition engine unit may be arranged to modify the predetermined number of repeats in response to the weight of the tubular corresponding to a known weight of the standard casing tubular.

The processing resource may be arranged to support a torque calculation unit; the apparatus may further comprise: a third sensor input operably coupled to the torque calculation unit and arranged to receive, when in use, third data corresponding to a third time-varying sensor signal; and the torque calculation unit may be arranged to use the third sensor data in respect of the candidate casing time window to increase confidence in the determination of the deployment of the casing in the borehole.

The rotational measurement unit may be arranged to measure torque and/or rotation.

The third sensor data may comprise magnitude data; and the torque calculation unit may be arranged to evaluate a magnitude of the magnitude data with respect to a predetermined reference magnitude value.

The processing resource may be arranged to support a pressure calculation unit; the apparatus may further comprise: a fourth sensor input operably coupled to the pressure calculation unit and arranged to receive, when in use, fourth sensor data corresponding to a fourth time-varying sensor signal; and the signal pattern recognition engine unit may be arranged to identify a pattern described by the first, third and fourth sensor data in respect of the candidate casing time window indicative of an inserted casing overcoming an obstruction in the borehole.

The processing resource may be arranged to identify time periods when slips events are employed and provide, when in use, slips state data to the signal pattern recognition engine unit; and the signal pattern recognition engine unit may be arranged to analyze the second sensor data in respect of the candidate casing time window in order to identify an indicator indicative of casing deployment; the indicator may comprise insertion of at least a predetermined number of tubulars into the borehole without off-slips events therebetween.

The processing resource may be arranged to support a pressure calculation unit; the apparatus may further comprise: a fourth sensor input operably coupled to the pressure calculation unit and may be arranged to receive, when in use, fourth sensor data corresponding to a fourth time-varying sensor signal; and the pressure calculation unit may be arranged to analyze the fourth sensor data in respect of the candidate casing time window in order to identify another indicator that the casing has in fact been deployed in the borehole.

The signal pattern recognition engine unit may be arranged to scan a predetermined time range before an end of the candidate casing time window; and the signal pattern recognition engine unit may be arranged to evaluate the first sensor data in respect of the predetermined time range with respect to a predetermined value.

The first sensor data may be hookload data and the predetermined value may be a predetermined hookload value; and the evaluation of the first sensor data with respect to the predetermined value may be a determination of a hookload exceeding the predetermined hookload value.

The signal pattern recognition engine unit may be arranged to analyze the first sensor data in respect of the candidate casing time window in order to identify a predetermined pattern of hookload and pressure indicative of a drillstring passing through casing into an uncased region of the borehole followed by commencement of drilling.

The signal pattern recognition engine unit may be arranged to analyze the first and fourth sensor data in respect of the candidate casing time window in order to identify: a cycle of increasing hookloads; a subsequent increase in the hookload and pressure indicative of the drillstring entering the uncased region of the borehole; and a subsequent reduction in the hookload and the pressure indicative of the commencement of the drilling.

The block position calculation unit may be arranged to analyze a preceding time range immediately before the candidate casing time window in order to determine whether during the preceding time range a tubular corresponding to a drillstring is at the surface.

The signal pattern recognition engine unit may be arranged to analyze the first sensor data in respect of an initial time region of the candidate casing time window in order to determine whether the first sensor data within the initial time region comprises a hookload pattern indicative of an initiation of deployment of casing.

The signal pattern recognition engine unit may be arranged to analyze the candidate casing time window in order to determine whether a casing string comprises a plurality of tubulars of consistent length.

The signal pattern recognition engine unit may be arranged to analyze the first sensor data in respect of the candidate casing time window in order to determine a first hookload in respect of tripping in a run of tubular and a second hookload in respect of tripping out; and the signal pattern recognition engine unit may be arranged to determine whether the first hookload is different to the second hookload by at least a predetermined hookload difference.

The signal pattern recognition engine unit may be arranged to analyze the first and third sensor data in respect of the candidate casing time window in order to identify a pattern of hookload and torque or rotation indicative of deposition of a borehole liner.

According to a fifth aspect of an embodiment of the present disclosure, there is provided a cementing detection apparatus, the apparatus comprising: a casing deployment detection apparatus as set forth above in accordance with the fourth aspect of the invention; wherein the processing resource is arranged to support a time window controller, the time window controller being arranged to identify a casing time window associated with the identified deployment of the casing in the borehole; the time window controller is also arranged to identify an end of the casing time window; and the time window controller is arranged to set a forward analysis time point at or after the end of the casing time window.

The block position calculation unit may be arranged to analyze the second sensor data in order to detect whether a plurality of tubulars are inserted into the borehole; the block position calculation unit may be arranged to count a number of tubulars inserted into the borehole in response to detection of the insertion of the plurality of tubulars; and the block position calculation unit may be arranged to count a number of tubulars removed from the borehole after the insertion of the plurality of tubulars into the borehole.

The decision unit may be arranged to determine whether the number of tubulars inserted into the borehole is substantially the same as the number of tubulars removed from the borehole thereafter; and time window controller is arranged to advance the forward analysis time point to a time corresponding to an end of the removal of the tubulars from the borehole.

The block position calculation unit may be arranged to analyze the second sensor data in order to determine whether tubular movement is absent within a predetermined preliminary time range from the forward analysis time point.

The processing resource may be arranged to support a pressure calculation unit; the apparatus may further comprise: a fourth sensor input operably coupled to the pressure calculation unit and arranged to receive, when in use, fourth sensor data corresponding to a fourth time-varying sensor signal; and the signal pattern recognition engine unit may be arranged to analyze the pressure sensor data to identify a pattern of application of pressure over a predetermined testing period of time; the predetermined testing period of time may correspond to a duration of a cementing operation.

The decision unit may be arranged to record the forward analysis time point as indicative of a commencement of a cementing operation.

The pressure calculation unit may be arranged to analyze the pressure sensor data in order to detect a pressure pattern indicative of an end phase of a cementing operation.

The processing resource may be arranged to analyze the first sensor data and/or the second sensor data and to determine whether the first sensor data and/or the second sensor data may comprise a period of inactivity following the detected end of the cementing operation that is greater than a predetermined inactivity time period.

The processing resource may be arranged to analyze the first sensor data and/or the second sensor data in order to determine whether activity following the predetermined inactivity time period is an activity that should not follow the cementing operation.

The processing resource may be arranged to record a point in time immediately preceding the detected activity in response to the activity being detected as an activity that is expected to follow the cementing operation, the point in time being recorded as indicative of an end of the cementing operation.

The pressure calculation unit may be arranged to analyze the pressure sensor data in order to determine a period of inactivity indicative of a period of time during which cementing resources are awaited.

According to a sixth aspect of an embodiment of the present disclosure, there is provided a casing deployment detection system comprising: a casing deployment detection as set forth above in accordance with the fourth aspect of the invention; a first sensor operably coupled to the first sensor input; and a second sensor operably coupled to the second sensor input.

The first sensor may be a hookload sensor and the second sensor may be a block position sensor.

The system may further comprise a third sensor operably coupled to the processing resource. The third sensor may be a torque sensor or a rotation sensor.

The system may further comprise a fourth sensor operably coupled to the processing resource. The fourth sensor may be a pressure sensor.

According to a seventh aspect of an embodiment of the present disclosure, there is provided a cementing detection system comprising the casing deployment detection system as set forth above in accordance with the fifth aspect of the invention.

It is thus possible to provide a method and apparatus capable of inferring the deployment of casing and/or the performance of a cementing operation in a manner that obviates or at least mitigates human interaction. The ability to detect automatically casing/cementing from drilling surface measurements provides improved process diagnostics as well as the ability to provide increased automation of a drilling operation. Additionally, the method and apparatus allows automated triggering of cementing operations. Automated systems lead to more accurate time analysis of rig activities and improved performance through accurate time analysis of the entire well operation. The apparatus and methods also facilitate the generation of automated, for example morning, reports. Furthermore, accurate and automatic identification of the start and finish of major tasks, facilitates multi-well programs and so-called "Factory Drilling" or automated drilling operations where the rig, well-site technology and constant remote operations engineer-based monitoring services are integrated.

BRIEF DESCRIPTION OF THE DRAWINGS

At least one embodiment of the invention will now be described, by way of example only, with reference to the accompanying drawings, in which.

Figure 1:
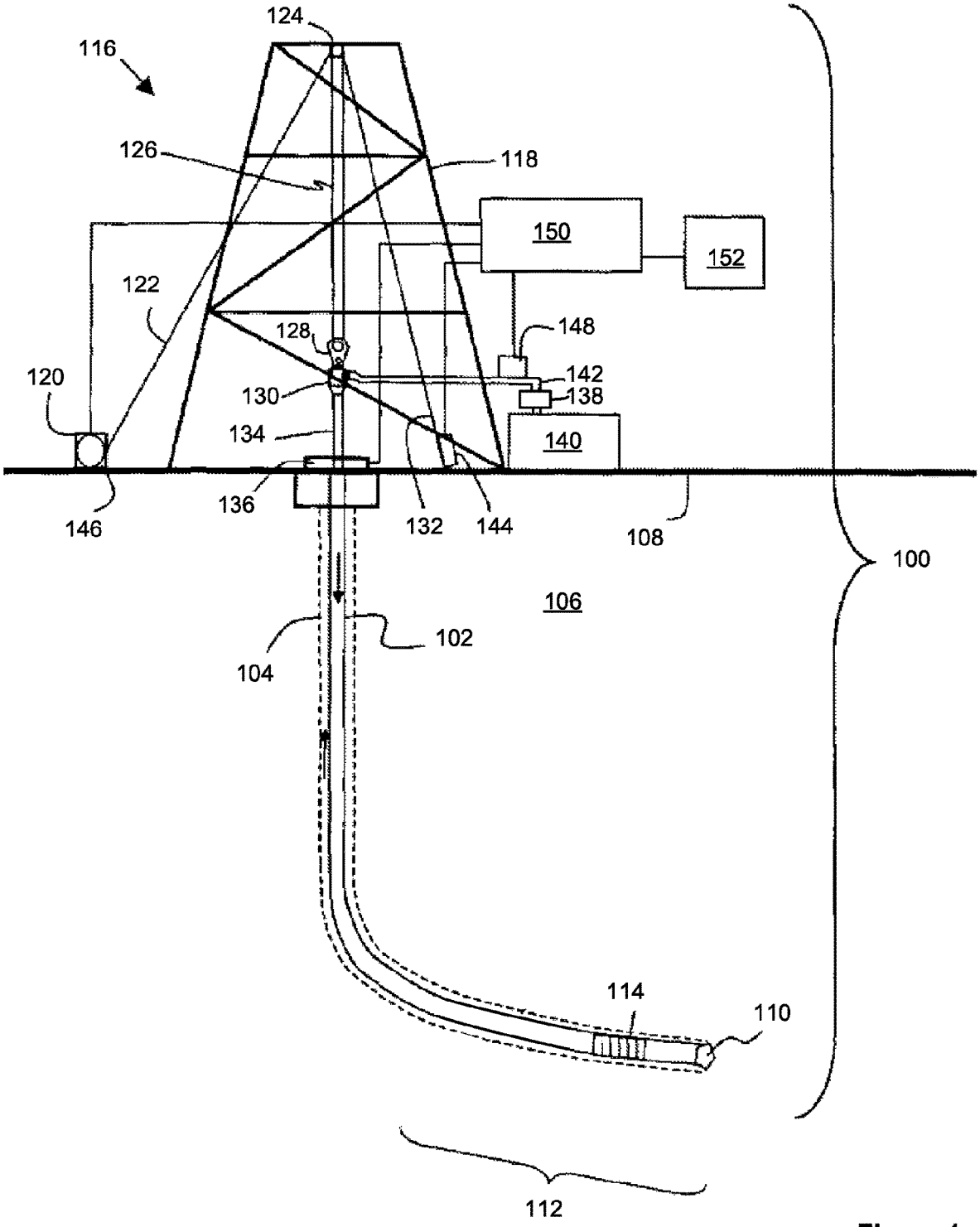
FIG. 1 is a schematic diagram of a drilling system employing a casing deployment detection apparatus and a cementing detection apparatus constituting respective embodiments of the invention.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

The ensuing description provides preferred exemplary embodiment(s) only, and is not intended to limit the scope, applicability or configuration of the invention. Rather, the ensuing description of the preferred exemplary embodiment (s) will provide those skilled in the art with an enabling description for implementing a preferred exemplary embodiment of the invention. It being understood that various changes may be made in the function and arrangement of elements without departing from the spirit and scope of the invention as set forth in the appended claims.

Specific details are given in the following description to provide a thorough understanding of the embodiments. However, it will be understood by one of ordinary skill in the art that the embodiments maybe practiced without these specific details. For example, circuits may be shown in block diagrams in order not to obscure the embodiments in unnecessary detail. In other instances, well-known circuits, processes, algorithms, structures, and techniques may be shown without unnecessary detail in order to avoid obscuring the embodiments.

Also, it is noted that the embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed, but could have additional steps not included in the figure. A process may correspond to a method, a function, a procedure, a subroutine, a subprogram, etc. When a process corresponds to a function, its termination corresponds to a return of the function to the calling function or the main function.

Moreover, as disclosed herein, the term "storage medium" may represent one or more devices for storing data, including read only memory (ROM), random access memory (RAM), magnetic RAM, core memory, magnetic disk storage mediums, optical storage mediums, flash memory devices and/or other machine readable mediums for storing information. The term "computer-readable medium" includes, but is not limited to portable or fixed storage devices, optical storage devices, wireless channels and various other mediums capable of storing, containing or carrying instruction(s) and/or data.

Furthermore, embodiments may be implemented by hardware, software, firmware, middleware, microcode, hardware description languages, or any combination thereof. When implemented in software, firmware, middleware or microcode, the program code or code segments to perform the necessary tasks may be stored in a machine readable medium such as storage medium. A processor(s) may perform the necessary tasks. A code segment may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted via any suitable means including memory sharing, message passing, token passing, network transmission, etc.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Referring to FIG. 1, a drilling system 100 comprises a drillstring 102 within a borehole 104. The borehole 104 is located in the Earth 106 having a surface 108. The borehole 104 is being cut by the action of a drill bit 110. The drill bit 110 is disposed at a far end of a bottomhole assembly 112 that is attached to and forms the lower portion of the drillstring 102. The bottomhole assembly 112 contains a number of devices including various subassemblies 114. However, the bottomhole assembly 112 is not core to the description of the examples set forth herein, and so for the sake of maintaining conciseness and clarity of description, the bottomhole assembly 112 will not be described in greater detail herein, other than to mention that in different embodiments, the bottomhole assembly 112 can comprise other telemetry systems, for example pressure pulse, wired pipe, fiber optic systems, acoustic systems, wireless communication systems and/or the like to transmit data to a surface system.

The drilling system 100 comprises a drilling rig 116, which includes a derrick 118 and hoisting system, a rotating system, and a mud circulation system. The hoisting system which suspends the drillstring 102, includes draw works 120, fast line 122, crown block 124, drilling line 126, traveling block and hook 128, swivel 132, and deadline 130. The rotating system includes Kelly 134, rotary table 136, and engines (not shown).

In this example, the drillstring 102 is connected to the rotary table 136, via the Kelly 134, and can suspend from the traveling block and hook 128, and additionally the rotary swivel 130. The rotary swivel 130 is suspended from the drilling rig 116 through the hook 128, and the Kelly 134 is connected to the rotary swivel 130 such that the Kelly 134 can rotate with respect to the rotary swivel 130. The Kelly 134 can be or include any configuration type having a set of polygonal connections or splines on the outer surface that mate to a Kelly bushing (not shown) such that actuation of the rotary table 136 can rotate the Kelly 134.

An upper end of the drillstring 102 is connected to the Kelly 134, such as by threadably reconnecting the drillstring 102 to the Kelly 134, and the rotary table 136 rotates the Kelly 134, thereby rotating the drillstring 102 connected thereto.

As will be understood, terminology used herein is used consistently with those in oilfield drilling industrial applications. As used herein, the term "slips" refers to a device that is used to grip the drillstring for a casing (see later herein) in a relatively non-damaging manner. This device can include three or more steel wedges that are hinged together forming a near circle around a drill pipe of the drillstring 102. On the drill pipe side (inside surface of the slips), the slips are fitted with replaceable hardened tool steel teeth that embed slightly into the side of the drill pipe when the slips are activated. The outsides of the slips are tapered to match a taper of the rotary table 136. After a rig crew places the slips around the drill pipe and in the rotary table 136, a driller can slowly lower the drillstring 102.

As the teeth on the inside of the slips grip the drill pipe, the slips are pulled down. This downward force pulls the outer wedges down providing a compressive force inward on the drill pipe and effectively locking everything together. Then, the rig crew can unscrew the upper portion of the drillstring 102 (above the slips) while the lower part is suspended due to the mechanical action of the slips. After another component is screwed onto the drillstring 102, the driller raises the drillstring 102 to unlock the gripping action of the slips and the rig crew removes the slips from the rotary. Thus, the term "in-slips" is reflective of a drillstring 102 that is being encompassed by a slips mechanism, as described above. The term "out-of-slips" reflects times when the drillstring 102 is not confined by a slips mechanism.

The drill rig 116 or a similar arrangement can be used to move the drillstring 102 within the well that is being drilled through subterranean formations. The drillstring 102 can be extended into the subterranean formations with a number of coupled drill pipes of the drillstring 102. An illustrative drill pipe is shown and described in U.S. Pat. No. 6,174,001, entitled "Two-Step, a Low Torque, Wedge Thread for Tubular Connector," which issued Aug. 7, 2001, to Enderle, which is incorporated herein by reference in its entirety.

As used herein, "stand" refers to two or three single joints of drill pipe or drill collars that remain screwed together during tripping operations. In some embodiments, four or more joints or sections can be used. In some embodiments, deep capacity drilling rigs handle three joint stands, called "triples." Some smaller rigs have the capacity for two joint stands called "doubles." In each case, the drill pipe collars are stood back upright in the derrick and placed into finger boards to keep them orderly. This is a relatively efficient way to remove the drillstring 102 from the borehole 104 when changing the drill bit 110 or making adjustments to the bottomhole assembly 112 rather than unscrewing the threaded connection and laying the pipe down to a horizontal position.

As used herein, "tripping" refers to the act of pulling the drillstring 102 out of the borehole 104 or running it into the borehole 104. A pipe trip, for example, is oftentimes done because the drill bit 110 has dulled or has otherwise ceased to drill efficiently, at which point it is replaced.

Several of the components disposed near to the drill rig 116 can be used to operate components of the overall drilling system 100. These components will be explained with respect to their uses in drilling the borehole 104 for a better understanding thereof. The drillstring 102 can be used to turn and urge the drill bit 110 into the bottom the borehole 104 to increase the length (depth) of the borehole 104. During drilling of the borehole 104, a pump 138 lifts drilling fluid (mud) from a tank 140 or pits and discharges the mud under pressure through a standpipe 142 and a flexible conduit or hose, and into an interior passage inside the drillstring 102. The mud, which can be water or oil-based, exits the drillstring 102 through courses or nozzles (not shown) in the drill bit 110, and the mud cools and lubricates the drill bit 110 and lifts drill cuttings generated by the drill bit 110 to the surface of the Earth through an annular arrangement.

During the course of a drilling program, the borehole 104 typically has one or more "casing string" runs, which are cemented in place. A typical drilling program first involves drilling a large diameter borehole from the Earth's surface for several thousand feet. A "surface casing" string is then run into the borehole and cemented in place. After the cement in the annulus has cured or hardened, another drill bit is utilized to drill through the cement in the surface casing to drill a second and deeper borehole into the earth formations. Typically, the subsequent drill bit has a smaller diameter that the initial drill bit such that the second borehole has a smaller diameter than the diameter of the surface borehole.

With respect to the section of borehole 104 subsequently drilled below a surface casing, at an appropriate depth, the drilling of the borehole is discontinued and a string of pipe commonly called a casing or liner is inserted through the surface casing. As a matter of nomenclature, a liner is a string of pipe typically suspended in the lower end of the previously set casing by a liner hanger so that the lower end of the liner does not touch the bottom of the borehole 104 and the liner thus is suspended under the tension of the pipe weight on the liner hanger. In some instances, a liner is set on the bottom of the borehole but its upper end does not extend to the Earth's surface.

If the pipe set in the borehole subsequently drilled extends to the surface of the earth it is also called a casing. When the cementing operation is completed and the cement sets, there is a column of cement in the annulus of the subsequent string of pipe. The casing strings are usually comprised of a number of joints, each being on the order of forty feet long, connected to one another by threaded connections or other connection means. Also, the joints are typical metal pipes, but may also be non-metal materials such as composite tubing.

Typically, the casing string is merely gravity fed into a vertical borehole. If a top drive rig is used, the rig can hydraulically force the casing string down into the borehole. If gravity fed, however, the weight of the casing is used to install the casing in the borehole. Typically, a casing shoe is disposed on the lower end of the casing string to close off the lower end of the casing string. The casing shoe closes off the lower end of the string so that the casing then serves as a pressure vessel in which fluid pressure can be applied to help force the casing down hole. The shoe typically is bullet shaped with a spherical-type face. A float valve may be attached to the lower end of the casing that allows the fluid to pass down the casing and out through the lower end to allow fluid circulation.

New casing sections are added until the casing string reaches the bottom of the newly drilled borehole.

Various sensors are placed on the drilling rig 116 to take measurement of the drilling equipment. In particular hookload is measured by hookload sensor 144 mounted on the deadline 132, block position and the related block velocity are measured by a block sensor 146 which is part of the draw works 120. Surface torque is measured by a torque sensor 147 on the rotary table 136. Standpipe pressure is measured by the pressure sensor 148, located on standpipe 142. Signals from these measurements are communicated to a central surface processing resource 150. The surface processing resource 150 is, in this example, programmed to detect automatically certain most likely processing events based on the various input channels described later below. The surface processing workstation 150 supports a user interface system, which is designed inter alia to warn the drilling personnel of undesirable events and/or suggest activity to the drilling personnel to avoid undesirable events. In other examples, the surface processing workstation 150 can be arranged to generate a status of drilling operations to a user, via the interface system, and the user can manage the drilling operations using the status.

The surface processing workstation 150 is arranged, as described later below, to interpret the data collected by the various sensors mentioned above to provide an interpretation in terms of activities that may have occurred in producing the collected data. Such interpretation may be used to understand the activities of a driller, to automate particular tasks of a driller, and/or to provide training for drillers.

Figure 2:
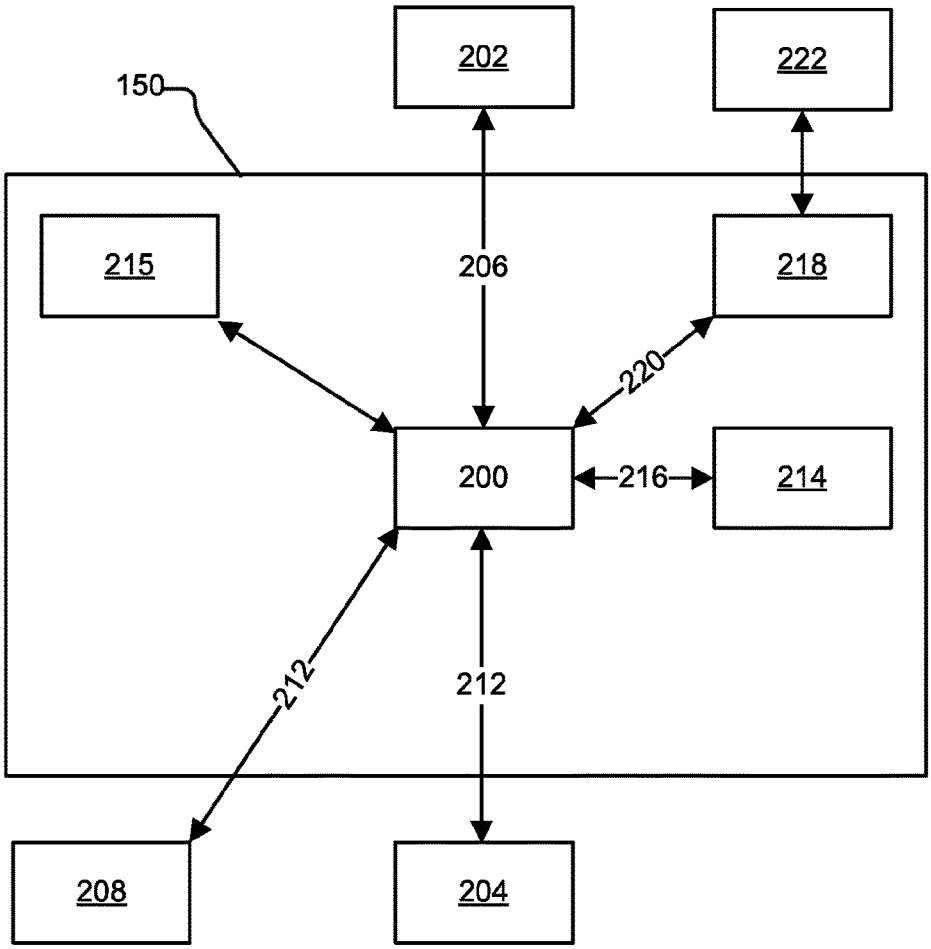
FIG. 2 is a schematic diagram of a central surface processing resource of the drilling system of FIG. 1 in greater detail.

Referring to FIG. 2, it should be noted that the block diagram of the surface processing workstation 150 is not inclusive of all components of the processing workstation, but is only representative of many example components. The processing workstation 150 is located within a housing (not shown). The processing workstation 150 can be, for example, a general-purpose computing apparatus, for example a Personal Computer (PC), or any other suitable computing device. The processing workstation includes, in this example, a processing resource, for example a processor 200, coupled to an input device 202 via an input device interface (not shown) and a display device, for example a display screen 204 via a display driver (also not shown). Although reference is made here to the input device 202 in the singular, the skilled person should appreciate that the input device 204 represents any number of input devices, including a keyboard device, mouse, trackball, voice input device, touch panel and/or any other known input device utilized to input information. Likewise, the display screen 204 can include any type of display screen, for example a Liquid Crystal Display (LCD). As is common with such computing apparatus, the processor 200 supports a Graphical User Interface (GUI) that operates in conjunction with the input device 202 and the display screen 204.

The processor 200 is operably coupled to and capable of receiving input data from input device 202 via a connection 206, and operatively connected to at least one of the display screen 204 and an output device 208, via respective output connections 212, to output information thereto. The output device 208 is, for example, an audible output device, such as a loudspeaker. The processor 200 is operably coupled to a memory resource 214 via internal connections 216, for example address and data buses, and is further adapted to receive/send information from/to input/output (I/O) ports 218 via connection 220, wherein the I/O port 218 is connectible to one or more I/O devices 222 external to the processing resource 150.

In this example, the I/O devices 222 are sensors, for example but not limited to, the hookload sensor 144, block sensor 146, the torque sensor 147 and the pressure sensor 148 mentioned above. The memory resource 214 comprises, for example, a volatile memory, such as a Random Access Memory (RAM) and a non-volatile memory, for example a digital memory, such as a flash memory. A storage device, for example a hard disc drive 215, or a solid state drive is also operably coupled to the processor 200 to provide high-capacity data storage capabilities. It should be noted that while the central processing workstation 150 is illustrated as being part of the drill site apparatus, it may also be located, for example, in an exploration company data center or headquarters.

The processing workstation 150 constitutes a casing deployment detection apparatus, and in some embodiments, a cementing detection apparatus. In conjunction with one or more of the hookload sensor 144, block sensor 146, the torque sensor 147 and the pressure sensor 148, the processing resource constitutes a casing deployment detection system and, in some embodiments, a cementing detection system.

Figure 3:
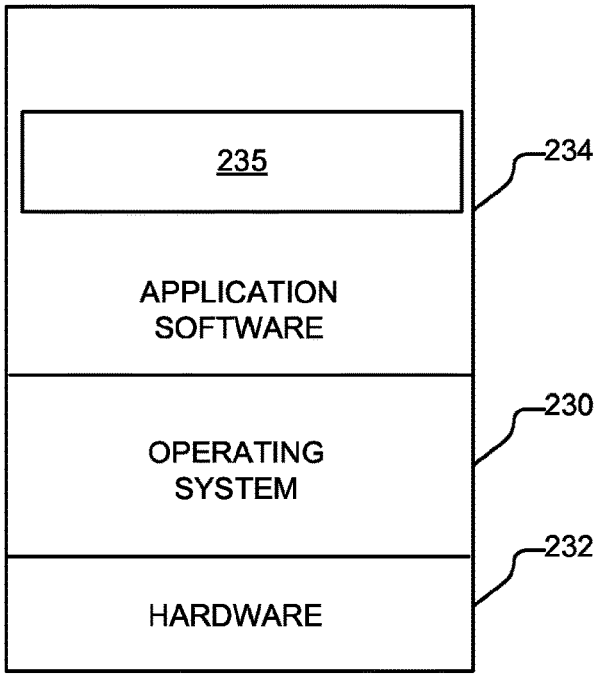
FIG. 3 is a schematic diagram of an architectural stack supported by the central surface processing resource of FIG. 2.

Turning to FIG. 3, the processor 200 of the central processing resource 150 loads an operating system 230 from the memory resource 214 and/or the hard drive 215 for execution by functional hardware components 232, which provides an environment in which application software 234 can run. The operating system 230 serves to control the functional hardware components 232 and resides between the application software 234 and the functional hardware components 232. The application software 234 provides an operational environment including the GUI 235 that supports core functions of the casing deployment detection apparatus and the cementing detection apparatus, for example data logging viewing, reservoir modelling and any other functions associated therewith.

Figure 4:
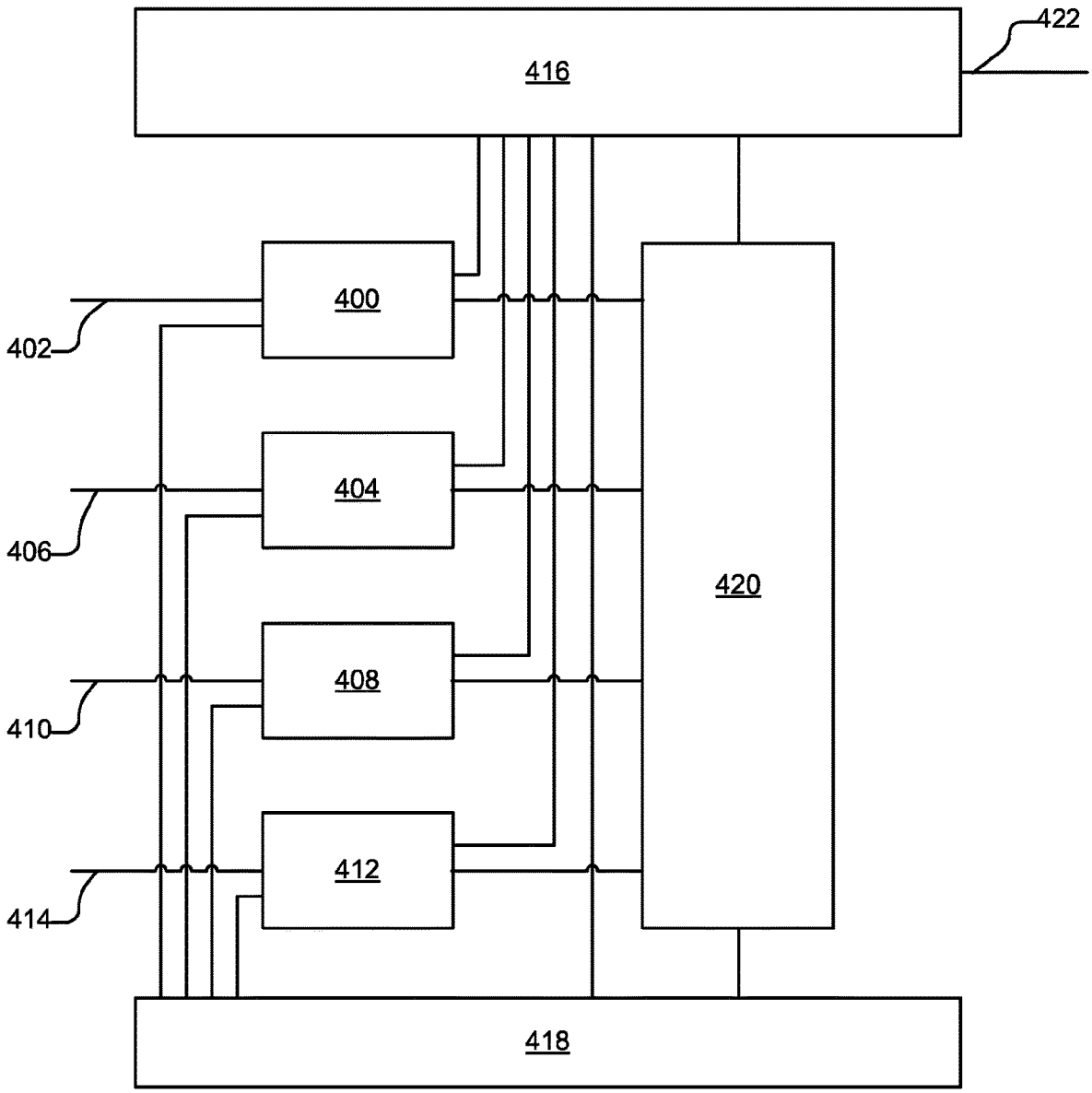
FIG. 4 is a schematic diagram of a casing deployment detection apparatus and a cementing detection apparatus constituting respective embodiments of the invention.

Referring to FIG. 4, as mentioned above, the operational environment supports application software. In the examples set forth herein, the performance of casing and cementing detection is described in the context of the application software. However, the skilled person will appreciate that the methods set forth herein need not be implemented in software and other hardware-based techniques can be employed, for example programmable hardware, such as Field Programmable Gate Arrays (FPGAs) or customizable integrated circuits, such as Application-Specific Integrated Circuits (ASICs).

The processing resource 200 supports a hookload calculation unit 400 having a first input 402 for receiving first sensor data corresponding to a first time-varying sensor signal, for example as generated by the hookload sensor 144 described above. A block position calculation unit 404 is also supported by the processing resource 200 and has a second input 406 for receiving second sensor data corresponding to a second time-varying sensor signal, for example as generated by the block sensor 146 described above. Likewise, the processing resource 200 supports a torque calculation unit 408 having a third input 410 for receiving third sensor data corresponding to a third time-varying sensor signal, for example as generated by the torque sensor 147 described above.

In some implementations, the torque sensor may not be available or data from the torque sensor may not be available, in which case a rotation sensor, if available, can be used and the torque calculation unit 408 can be replaced with a rotation calculation unit (not shown) with appropriate modification made to the functionality of the casing detection apparatus and/or the cementing detection apparatus. The processing resource 200 also supports a pressure calculation unit 412 having a fourth input 414 for receiving fourth sensor data corresponding to a fourth time-varying sensor signal, for example as generated by the pressure sensor 148 described above.

Each of the hookload calculation unit 400, the block position calculation unit 404, the torque calculation unit 408, and the pressure calculation unit 412 is respectively coupled to a processing supervisor unit 416 and a time window controller 418, also supported by the processing resource 200. The processing supervisor 416 comprises logic (not shown) capable of analysis, control and decision-making. The hookload calculation unit 400, the block position calculation unit 404, the torque calculation unit 408, and the pressure calculation unit 412 are also each respectively coupled to a signal pattern recognition engine unit 420, the signal pattern recognition engine unit 420 also being coupled to the processing supervisor unit 416 and the time window controller 418. The processing supervisor unit 416 also comprises a data output 422.

Figure 5:
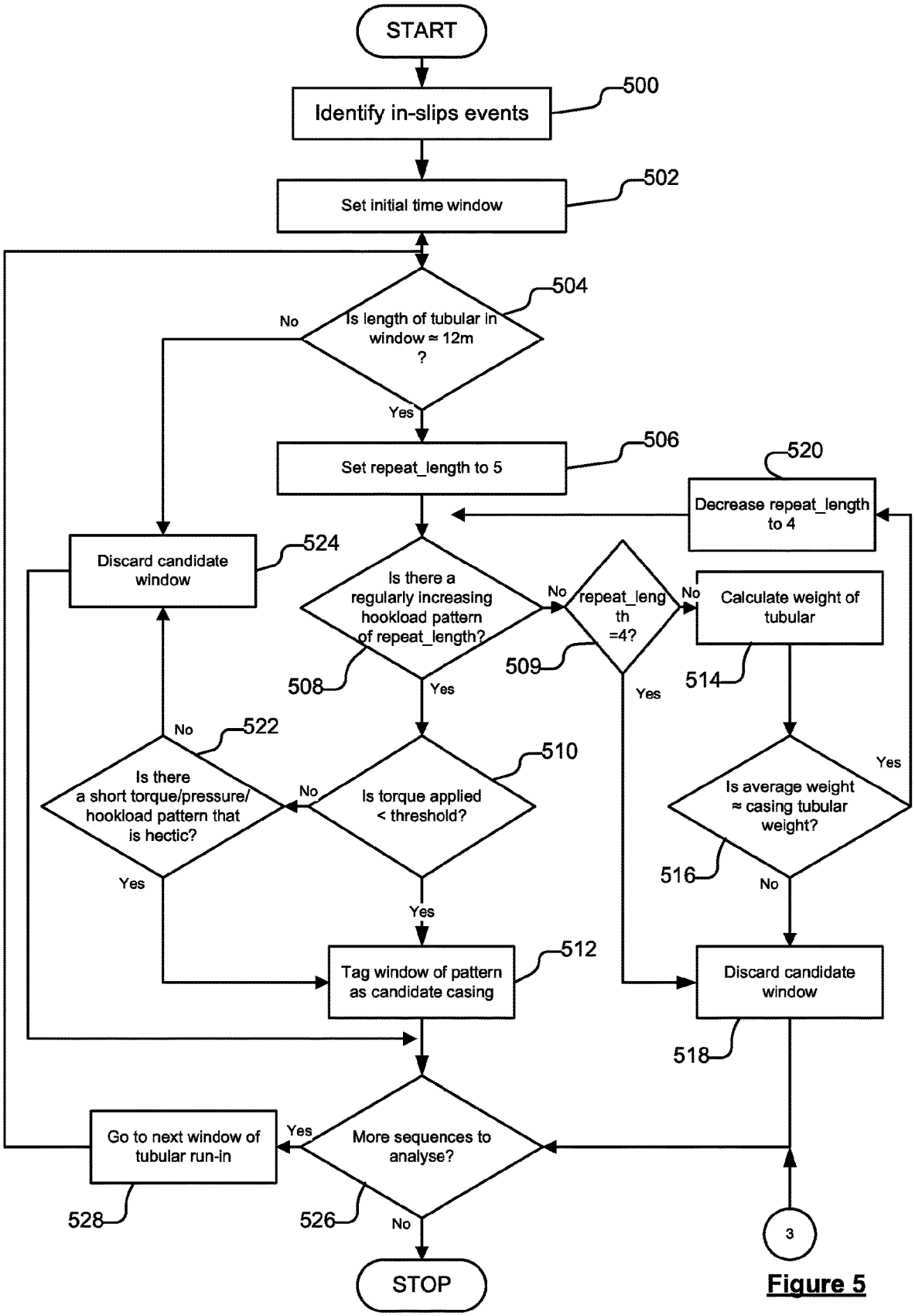
FIG. 5 is a flow diagram of a first stage of a method of detecting deployment of a casing in a borehole constituting another embodiment of the invention.

In operation (FIG. 5), following powering up of the surface processing workstation 150, the casing deployment detection apparatus analyzes the available data from sensors in order to identify (Step 500) in-slips events. This is done in accordance with the techniques described in U.S. Pat. No. 8,606,734 ("System and method for automatic exploration of production of subterranean resources"), US patent publication no. 2010/0124096 (Determining drillstring status in a wellbore") and Patent Cooperation Treaty patent publication no. WO 2010/010453 ("System and method for determining drilling activity"), which are incorporated herein by reference in their entirety.

The location of in-slips events are stored by the processing supervisor 416 for subsequent use by the signal pattern recognition engine unit 420. If the borehole 104 has not been completed and drilling, casing, cementing and other operations are on-going, then the in-slips event detection takes place as relevant data is received. However, if analysis of well operations is being performed as part of a post-processing exercise, then stored sensor data can be used to identify the in-slips events.

The casing deployment detection apparatus, as a first stage of processing, attempts to identify a candidate instance of casing being deployed in the wellbore. The candidate instance of casing occurs within a time window, which is referred to herein as a candidate casing time window. Sensor data in respect of the candidate casing time window is analyzed in order to implement the first stage of processing.

As such, once the in-slips events have been identified, the processing supervisor 416 instructs the time window controller 418 to select an initial candidate casing time window for analysis (Step 502). In this respect, the processing supervisor 416 can, in some examples, cooperate with the block position calculation unit 404 in order to identify tubular being raised. After setting of the initial candidate casing time window, the block position calculation unit 404 is used by the processing supervisor unit 416 in order to identify (Step 504) whether during the candidate casing time window a characteristic of the block position data, for example lengths of tubular being used, is approximately equal to the expected length of casing tubular.

In this example, the length of the expected casing tubular is about 12 meters or between about 40 ft. and 42 ft. As the skilled person will appreciate, different specifications exist for drill pipes and casing pipes, resulting in differences in length. In the case of certain combinations, the length of drill pipe used can be detectably shorter than casing pipe. However, for other well operations, the length of the drill pipes used can be relatively close to the length of the casing pipes used. In the event that the length of the individual tubulars used during the candidate casing time window is not consistent with the expected length of casing tubular, then the processing supervisor 416 discards (Step 526) the candidate casing time window as it is not deemed to relate to the deployment of casing in the borehole 104. Hence, a characteristic of first sensor data and a characteristic of second sensor data are each respectively analyzed in order to determine whether they are consistent with an expected characteristic of the first sensor data and an expected characteristic of the second sensor data, respectively.

However, in the present example, the individual tubular length is found to be consistent with the use of casing tubular and so, in addition to the characteristic of the length of tubular employed, another characteristic needs to be studied: pattern, for example hookload pattern. The processing supervisor 416 therefore instructs the signal pattern recognition unit 420 to set (Step 506) an initial repeat length sought, for example 5 repeats. The signal pattern recognition unit 420 then analyzes hookload data received by the hookload calculation unit 400 in order to detect (Step 508) a repeating pattern 600 of hookloads 602 (FIG. 6), where the hookload is increasing.

Figure 6:
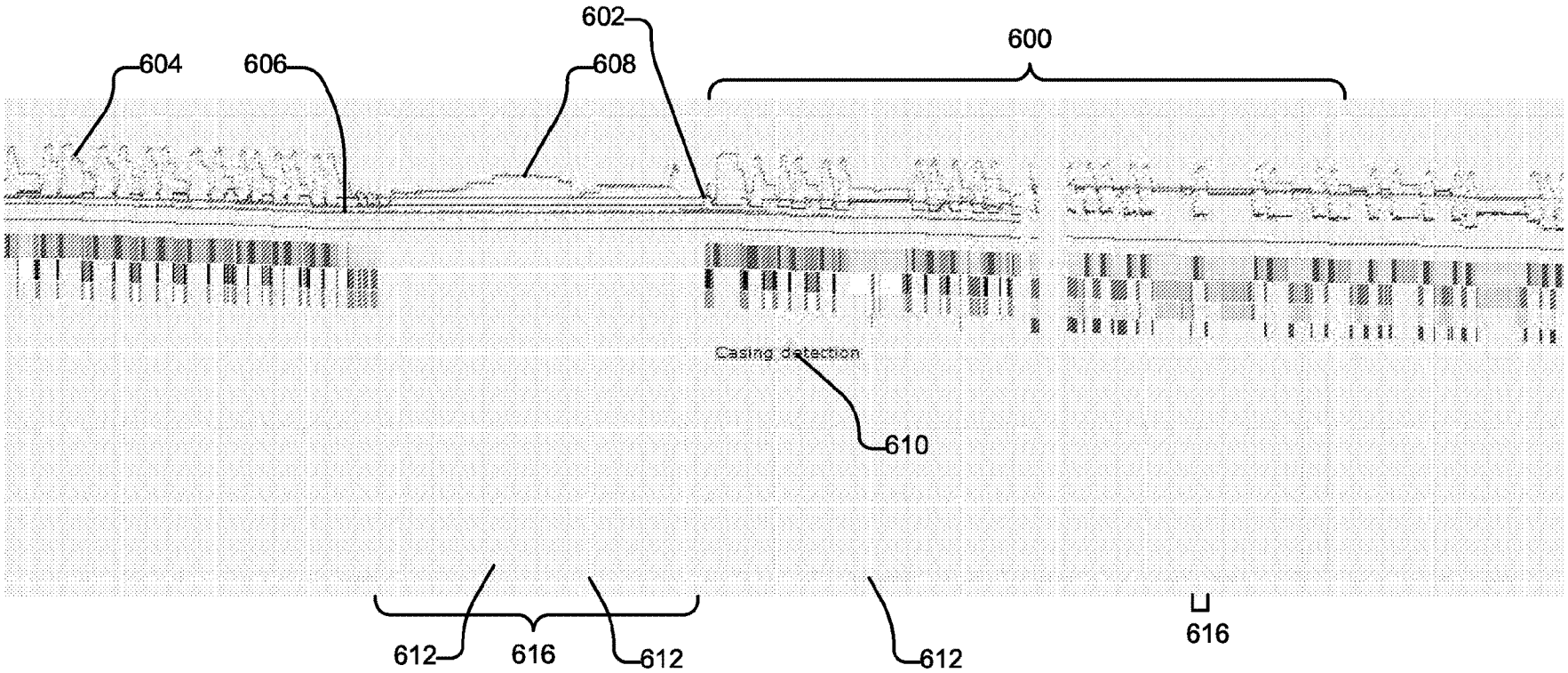
FIG. 6 is a screen shot of a data logging graphical user interface supported by the central surface processing resource of FIG. 2.
Figure 7:
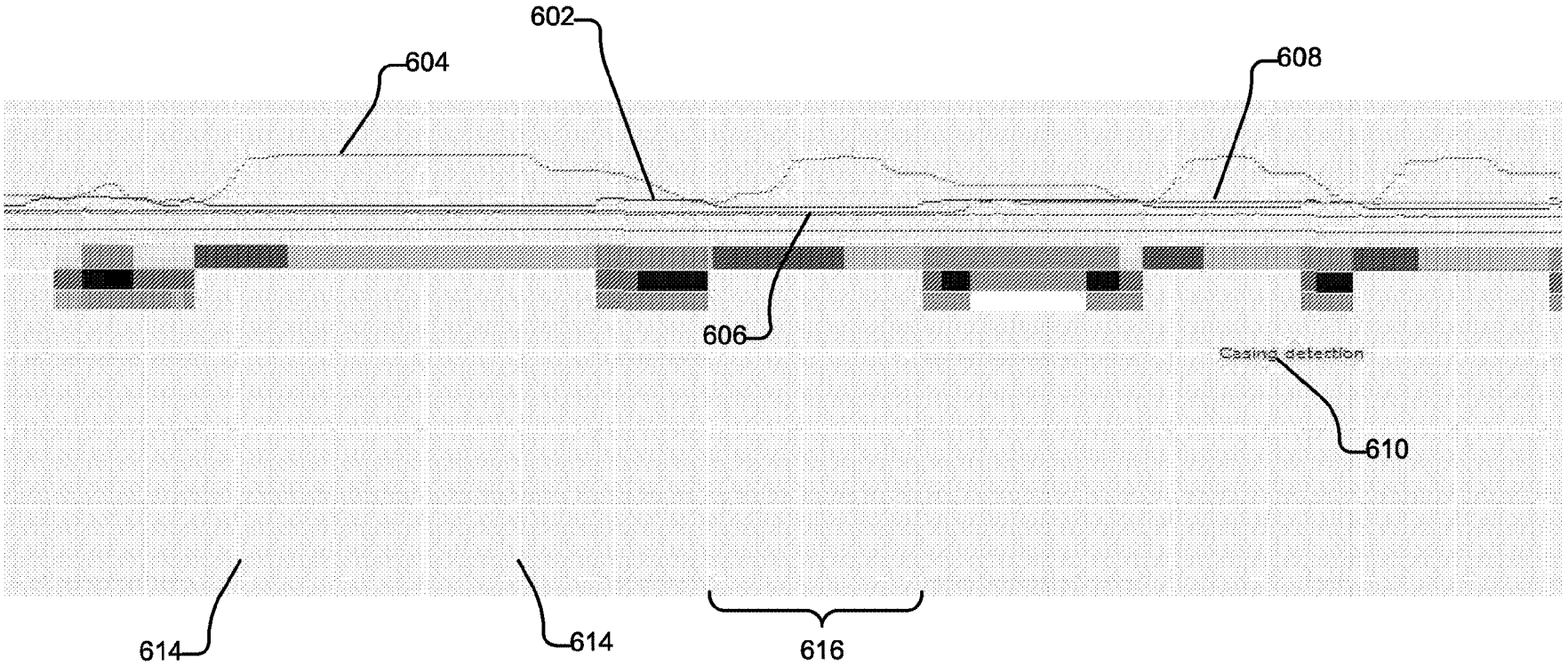
FIG. 7 is a portion of the screen shot of FIG. 6 in greater magnification.
Figure 8:
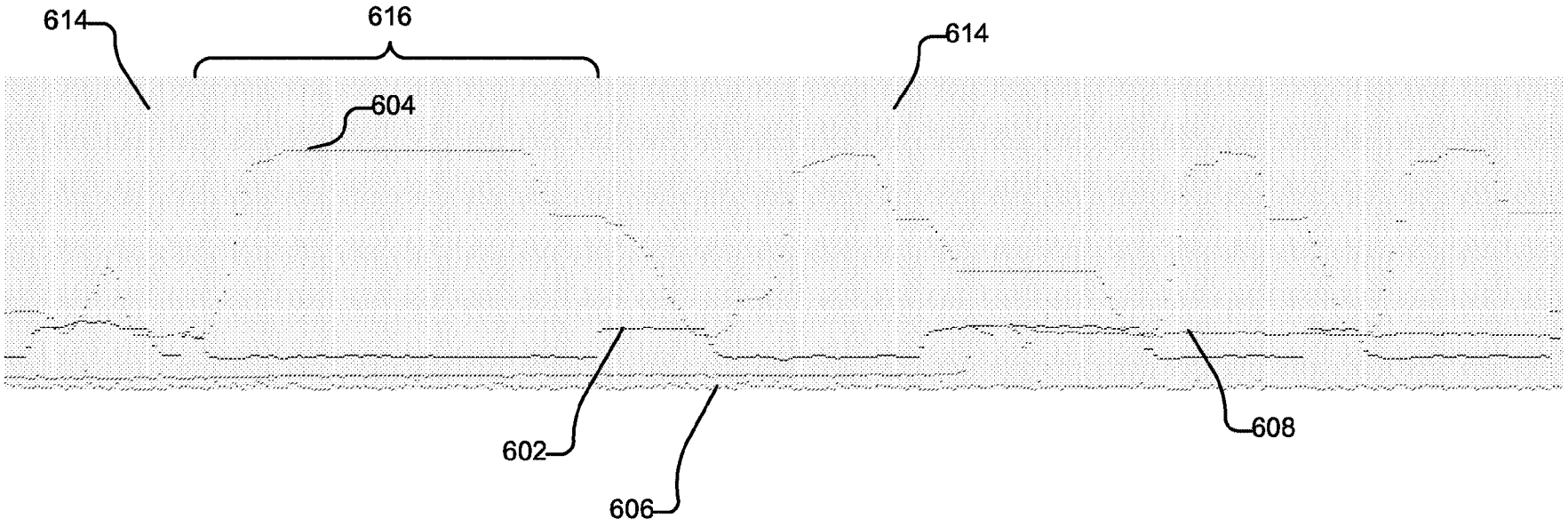
FIG. 8 is the portion of the screen shot of FIG. 7 without depth indexing.

Referring to FIGS. 6, 7 and 8, a data logging graphical user interface represents, in this example, four data channels used for input data, namely block position 604, hookload 602, torque 606, and pressure 608, according to one or more examples set forth herein. Block position, hook load, torque, and pressure are four distinct channels of data that are obtained during drilling operations from the above-mentioned sensors. Data relating to block position refers to the vertical position of an assembly of pulleys/sheaves on a common framework. The value of hook load is the amount of force exposed on the hook below the assembly of pulleys/sheaves.

Strain transducers on the sheave mechanisms or cables, for example, can be used to determine the overall loading on the hook. The hook, as described, is used to lift objects, such as drill pipes and casing pipes, during installation of such units during drilling and casing activities. Torque values are those values that the drillstring 102 is exhibiting during rotary operation in the wellbore 104 or when the values of torque applied when connecting sections of casing pipe. Pressure values are from pressure inside the standpipe 142 of the wellbore 104 being drilled. Such pressure values are obtained from pressure transducers constituting the pressure sensor 142.

In the present example, the signal pattern recognition unit 420 seeks a repeating pattern of 5 increasing hookloads, indicative of deployment of casing tubular into the wellbore. This can be achieved by seeking a correlation between the pattern received and an expected pattern. The combination of length and hookload pattern characterize the deployment of the casing in the borehole 104. However, it is desirable to verify further any inferences from the sensor data of deployment of casing. Thereafter, in order to further verify that casing is being detected, the processing supervisor 416 obtains torque-related information from the torque calculation unit 408. This constitutes third sensor data useful for increasing confidence in an initial identification of a casing run. This information is insightful because magnitude of torque applied during a casing run is usually lower than torque applied during drilling. Consequently, the torque calculation unit 408 determines (Step 510) whether the torque being applied to connect tubulars is consistent with the torque applied when connecting casing pipes.

The torque calculation unit 408 therefore compares the torque employed during the candidate casing time window with a threshold torque value, below which casing pipe is deemed to be torqued rather than drilling pipe. The threshold torque value depends upon the casing being used, which depends upon various borehole-related parameters that will be apparent to the skilled person. The result of the determination as to whether casing pipe or drilling pipe is being torqued is communicated by the torque calculation unit 408 to the processing supervisor 416. In the event that the torque being applied in respect of the candidate casing time window is indicative of torque being applied to casing tubulars, the processing supervisor tags (Step 512) parameter data associated with the candidate casing time window and stores the tagged candidate casing time window data for further analysis. In this respect, the further analysis will be described later herein.

In the event that the signal pattern recognition engine unit 420 is unable to identify a repeating pattern of increasing hookloads having a minimum repeat length of 5, the processing supervisor 416 determines whether the repeat length has been set to a value lower than the initial five repeats (Step 509), and if not, the processing supervisor 416 uses the hookload calculation unit 400 in order to determine the weight of an individual tubular during the candidate casing time window. In this regard, the hookload calculation unit 400 calculates (Step 514) the hookload of an individual tubular or pipe and the processing supervisor 416 determines (Step 516) whether the weight calculated is approximately the same as the weight of a single length of casing tubular.

In the event that the weight of the tubular used is determined not to be consistent with the use of casing tubular, the processing supervisor 416 discards (Step 518) the candidate casing time window, because it is deemed not to relate to deployment of casing in the borehole 104. On the other hand, in the event that the weight of the tubular used is determined to be consistent with the use of casing tubular, then the processing supervisor 416 instructs the signal pattern recognition engine unit 420 to reduce (Step 520) the repeat length by unity to 4. Thereafter, the above process to determine whether a repeating pattern of increasing hookloads is repeated, but in respect of a repeat length of four. In the event that the repeating pattern of 4 increasing hookloads is not identified, the processing supervisor 416 again checks (Step 509) whether the repeat length is already set to 4. When the repeat length is found to be set to 4, the weight assessment is not repeated and the processing supervisor 416 discards (Step 518) the candidate casing time window as it is not deemed to relate to the deployment of casing in the borehole 104. In the event that a repeating pattern of 4 increasing hookloads is identified by the signal pattern recognition engine unit 420, then the torque verification described above is performed (Step 510) and subsequent steps taken also as described above.

Returning to the assessment of torque described above (Step 504), in the event that the torque levels found during the candidate casing time window are greater than that used when joining sections of casing pipe, the processing supervisor 416 undertakes a check to determine (Step 522) whether the torque levels being applied are as a result of one of more borehole obstacles being encountered during deployment of casing tubular in the borehole 104 and attempts are being made to overcome the obstacle(s). In such circumstances, the high level of torque being used cannot be assumed to be exclusively as a result of drilling activity. In order to determine whether the levels of torque found during the candidate casing time window are attributable to attempts to overcome borehole obstacles while inserting casing into the borehole 104, the processing supervisor 416 instructs the signal pattern recognition engine unit 420 to analyze hookload data from the hookload calculation unit 400, torque data from the torque calculation unit 408 and pressure data from the pressure calculation unit 412 in order to identify a pattern of torque, pressure and/or hookload over, for example, a relatively short period of time. In this respect, it is necessary to ensure that casing overcoming an obstacle is not misinterpreted as a drilling operation, which would not be expected during a casing run.

A mistaken inference of a drilling operation when in fact casing is taking place, just with some difficulty, would lead to the candidate casing time window being discarded. In this example, one of more of the following types of analysis enables the signal pattern recognition engine unit 420 to distinguish between a pattern in the sensor data attributable to a bona fide casing operation and a confusingly similar pattern relating to a hole boring activity. For example, the patent disclosures referenced above disclose a technique for automatic recognition of hole boring, which can be implemented by the processing resource. If more than one consecutive boring "tubular" is detected entering the borehole, then running casing while overcoming an obstacle is unlikely.

Additionally or alternatively, the pattern in the sensor data from a casing tubular overcoming an obstacle is much shorter than a pattern associated with boring a hole. As such, the signal pattern recognition engine unit 420 can determine whether the duration of a pattern under investigation is less than a predetermined period of time, for example about 10 minutes. Additionally or alternatively, bona fide hole boring has a regular pattern associated with it, including for example a constant pressure and a constant torque, which can be determined from the pressure calculation unit 412 and the torque calculation unit 408. Hence, if the signal pattern recognition unit 420 detects a structured pattern rather than a pattern lacking structure, then the pattern is unlikely to be indicative of casing overcoming an obstacle.

In the event that the signal pattern recognition engine unit 420 identifies the pattern of torque, pressure and/or hookload indicative of obstacle clearance, the processing supervisor tags (Step 512) parameter data associated with the candidate casing time window and stores the tagged candidate casing time window data for further analysis. However, if the short pattern of torque, pressure and hookload is not found, the processing supervisor 416 discards (Step 524) the candidate casing time window, because the higher level of torque is not "excusable" for relating to obstacle clearance and so the candidate casing time window is not deemed to relate to the deployment of casing in the borehole 104.

Once the parameters of a candidate casing time window is discarded, the processing supervisor 416 then determines (Step 526), using information held by the time window controller 418, whether further elapses of time need to be analyzed, or whether all available data has been analyzed. In the event that further periods of time remain to be analyzed in order to seek an instance of candidate casing deployment suitable for further analysis, then the above-described process (Steps 504 to 524) is repeated, otherwise the operation of the casing deployment detection apparatus halts until all time windows have been analyzed.

In contrast, when a candidate casing time window has been tagged by the processing supervisor 416, the casing detection apparatus proceeds thereafter to a second stage in which sensor data in respect of the tagged candidate casing time windows is further analyzed in order to find evidence to deselect the candidate casing time window for reasons of not relating to the deployment of casing in the borehole 104.

Figure 9:
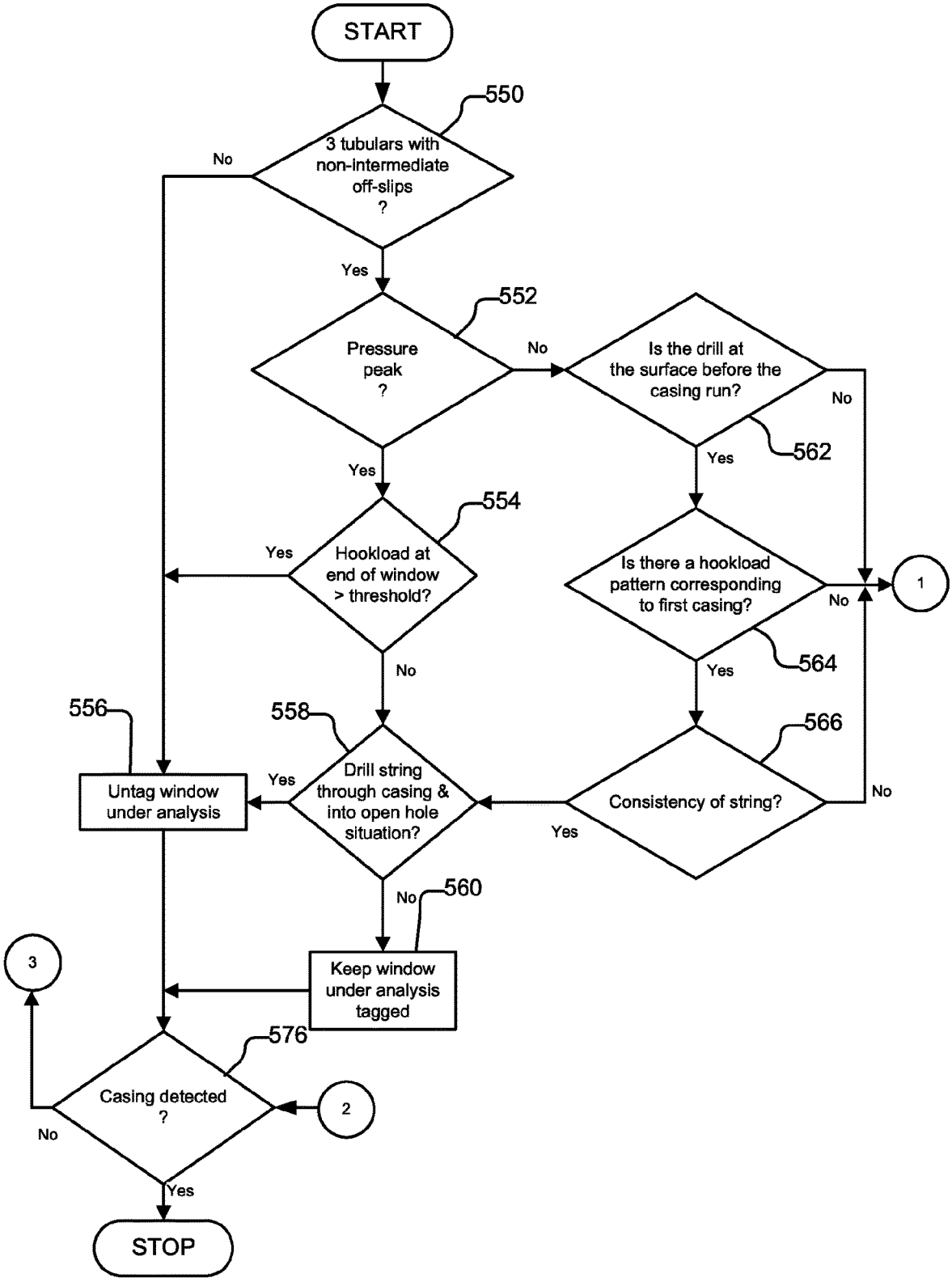
FIG. 9 is a flow diagram of a second stage of the method of detecting deployment of the casing in the borehole constituting a further embodiment of the invention.

Referring to FIG. 9, the second stage of further analysis starts by the processing supervisor 416 instructing the signal pattern recognition engine unit 420 to use the in-slips event data previously generated and block position data obtained from the block position calculator unit 404 in order to determine (Step 550) in respect of the candidate casing time window whether three tubulars are being joined with no off-slips events between connections, this being indicative of a casing run. If the three tubulars with no intermediate off-slips events is not identified by the signal pattern recognition engine unit 420, then the processing supervisor 416 deselects (Step 554) the candidate casing time window as it is not deemed to relate to the deployment of casing in the borehole 104. However, in the event that the pattern of three tubulars with no intermediate off-slips events is identified by the signal pattern recognition engine 420, this can be, or be part of, an indicator that casing is being deployed in fact, and the processing supervisor 416 then analyses (Step 552) the pressure data provided by the pressure calculation unit 412, as the detection of sudden peaks of pressure can be indicative of commencement of cementing after casing. In this respect, the peaks in pressure may be attributable to pressure testing and/or a plug being released at the beginning of cementing. For example, during cementing pressure needs to be raised in order to rupture a bottom plug that travels to the bottom of the casing and then, subsequently, when a top plug is inserted into the casing and reaches the bottom of the casing additional pressure can be observed associated with the end of fluid movement.

In the event that the pressure peaks are detected, this is indicative that casing has possibly already been completed, in which case analysis is on a post-processing basis. In any event, in response to detection of the pressure peaks, the processing supervisor 416 attempts to confirm the completion of the deployment of casing by obtaining hookload data from the hookload calculation unit 400 in respect of a predetermined time range before the end of the candidate casing time window in order to detect (Step 554) a high hookload after detection of the pressure peaks, for example by comparing the detected hookload with respect to a threshold hookload value, the threshold hookload value delineating between weights deemed high and not high. Such an occurrence should not happen in the event that casing has been completed. In the event that a subsequent high hookload is identified by the processing supervisor 416, the processing supervisor 416 deselects (Step 556) the candidate casing time window as it is not deemed to relate to the deployment of casing in the borehole 104.

The hookload observed can be compared with, for example, an average hookload to determine if the observed hookload is a multiple of the average hookload. An example of calculating the average hookload is described later herein.

However, if no high hookload is detected by the processing supervisor 416, the processing supervisor 416 attempts to detect (Step 558) from the available sensor data in respect of the candidate casing time window an inference that the drillstring is nevertheless being passed through already-set casing and passing into an uncased open region beneath the casing and then drilling is commenced. In this respect, such behavior occurs during drilling and cannot occur immediately after deployment of casing. As such, if such a pattern is identified, then any assumption that the candidate casing time window relates to deployment of casing in the borehole 104 is erroneous. To recognize this pattern, the signal pattern recognition engine unit 420 analyzing sensor data from the hookload calculation unit 400 and the pressure calculation unit 412 in order to identify a cycle of increasing hookloads, followed by a considerable increase in the hookload and pressure indicative of the drillstring entering an uncased region of the borehole 104. The signal pattern recognition engine unit 420 then tries to identify a reduction in the hookload and the pressure indicative of the commencement of the drilling.

In the event that the pattern of hookload and pressure infers the drillstring passing through already-set casing and into an uncased open region beneath the casing, followed by commencement of drilling, the processing supervisor 416 discards or deselects (Step 556) the candidate casing time window as it is not deemed to relate to the deployment of casing in the borehole 104. Alternatively, if the passage of a drill bit through already-set casing and into an uncased open region beneath the casing, followed by commencement of drilling, is not detected, the processing supervisor 416 retains (Step 560) the tagged status of the candidate casing time window.

Returning to the analysis of pressure data (Step 552), in the event that no pressure peak is detected by the pressure calculation unit 412, the possibility exists that the sensor data is being received in real-time and so cementing may not be happening yet. The processing supervisor 416 therefore obtains block position data from the block position calculation unit 404 in order to determine (Step 562) if the drill is at the surface, the position of the drill at the surface being usual before casing is to be deployed in the borehole 104. If the processing supervisor 416 determines that the drill is at the surface, the processing supervisor 416 instructs the signal pattern recognition engine unit 420 to try to identify (Step 564), during the candidate casing time window, a hookload pattern indicative of an initiation of a casing run, for example a pattern consistent with use of a first part of casing assembly, for example use of a bottomhole assembly.

Thereafter, if the first casing hookload pattern is identified, the processing supervisor 416 attempts to determine (Step 566) if the string is formed from a minimum number of consistent lengths of casing tubular, for example at least three tubulars of the same length. In the event that the string is found to be regular, as an additional verification, the processing supervisor determines (Step 558) whether the sensor data during the candidate casing time window infers the passage of the drill bit through already-set casing and into an uncased open region beneath the casing, followed by commencement of drilling. In the event that such a series of events is detected, the processing supervisor 416 discards (Step 556) the candidate casing time window as it is not deemed to relate to the deployment of casing in the borehole 104. Otherwise, the processing supervisor 416 retains (Step 560) the tagged status of the candidate casing time window.

Figure 10:
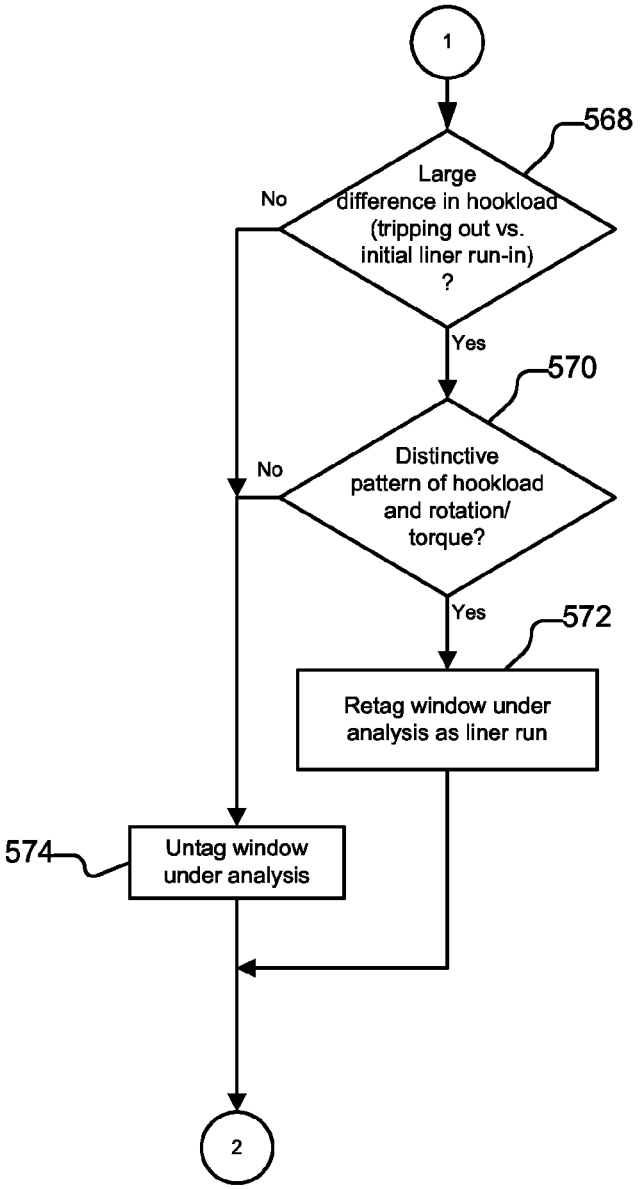
FIG. 10 is an option portion of the flow diagram of FIG. 9 for the detection of deployment of a liner constituting a further embodiment of the invention.

If any of the above "real-time" evaluations (Steps 562 to 566) result in nothing being found, in one example implementation, the processing supervisor 416 can proceed to determine whether or not a liner is being deployed in the borehole 104. Referring to FIG. 10, this analysis is optional and need not be carried out. In this example, the processing supervisor 416 obtains data from the hookload calculation unit 400 during the candidate casing time window in respect of tripping tubular out and tripping tubular in. The processing supervisor 416 compares the hookloads associated with tripping in and tripping out in order to determine (Step 568) whether there is a large difference between the two hookloads. This is an initial indicator that liner is being lowered into the borehole 104, but obviously not returning to the surface once disposed in place.

To confirm the possibility of a liner run, the processing supervisor 416 instructs the signal pattern recognition engine unit 420 to obtain pressure data from the pressure calculation unit 400 and/or hookload data and torque data from the hookload calculation unit 400 and the torque calculation unit 408, respectively. The processing supervisor 416 then instructs the signal pattern recognition engine unit to identify (Step 570) any pressure peaks and/or distinctive patterns of hookload and toque during the candidate casing time window. In this respect, where the liner is being set using a hydraulic technique a rise in pressure exists where the casing string is engaged for lowering in the borehole, the pressure reducing as the liner is set in the borehole.

In relation to mechanical setting of the liner, the liner is inserted into the borehole and then rotated until a setting point is reached. Thereafter, torque is applied to the liner to disengage it from a drillstring being used to set the liner. In the event that the pressure peak and/or distinctive pattern of hookload and torque is found, then the processing supervisor 416 modifies (Step 572) the tag for the candidate casing time window to indicate that the time window relates to the deployment of a liner. However, if the pressure peak and/or the distinctive pattern of hookload and torque is/are not found, or the large difference in hookload between tripping in and tripping out (Step 568) is not found, then the processing supervisor 416 discards (Step 574) the candidate casing time window as it is not deemed to relate to the deployment of casing in the borehole 104.

Once the candidate casing time window has either been maintained, deselected or modified in accordance with the process set out above (Steps 550 to 574), the processing supervisor 416 determines (Step 576) whether the candidate casing time window remains tagged as casing, in which case the above analysis stops and output data is generated, otherwise the processing supervisor 416 returns to determining (Step 526-FIG. 5), using information held by the time window controller 418, whether further elapses of time are available for analysis in a repeated attempt to identify deployment of the casing in the borehole 104.

In order to detect an end of the casing run, the processing supervisor 416 determines when casing pipe is no longer being lowered into the borehole 104, namely the pattern described above constituting the lowering of the casing pipe into the borehole 104 is determined by the signal pattern recognition engine unit 420 to cease. The candidate casing time window is updates to reflect the determined time at which the pattern ceased.

As mentioned above, data is output when a candidate casing time window is confirmed by the second stage of analysis. In this respect, the processing supervisor 416 provides the parameters of the candidate casing time window at the data output 422 thereof, the parameters being used by the GUI 235 to identify where a casing operation is first detected and determined to end.

In this regard, and referring back to FIGS. 6, 7 and 8, a casing detection flag 610 is displayed by the GUI 235 at the point in time corresponding to the detection of deployment of casing in the borehole 104. As can be seen, the block position trace has a regular stepped pattern, which is interleaved with hookload step-like pulses. Time is marked at intervals 612 of 15 minutes in FIG. 6, whereas time is marked at intervals 614 of 1 minute in FIGS. 7 and 8. Additionally, detection of in-slips events is also communicated via the data output 422 and identified as background shaded vertical blocks 616.

Figure 11:
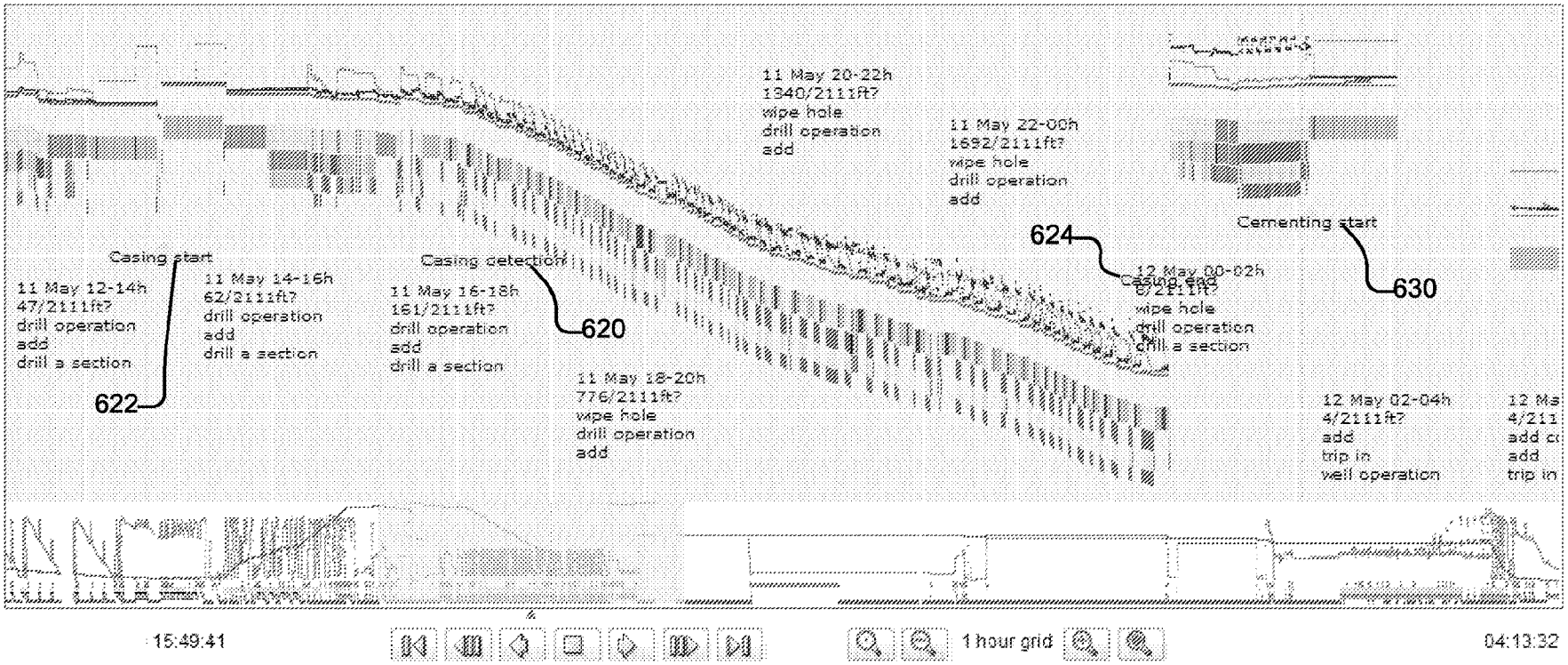
FIG. 11 is a screen shot of another data logging graphical user interface generated with the assistance of the method of FIGS. 5 and 9.

Referring to FIG. 11, the GUI 235 displays the detected start of casing 620, which as can be seen differs slightly from an actual start of casing 622, because the casing detection apparatus is searching for patterns, which need to be established for a determination of casing to be made in an automated manner. Where detectable, the end of the casing run 624 is also indicated by the GUI 235.

Figure 12:
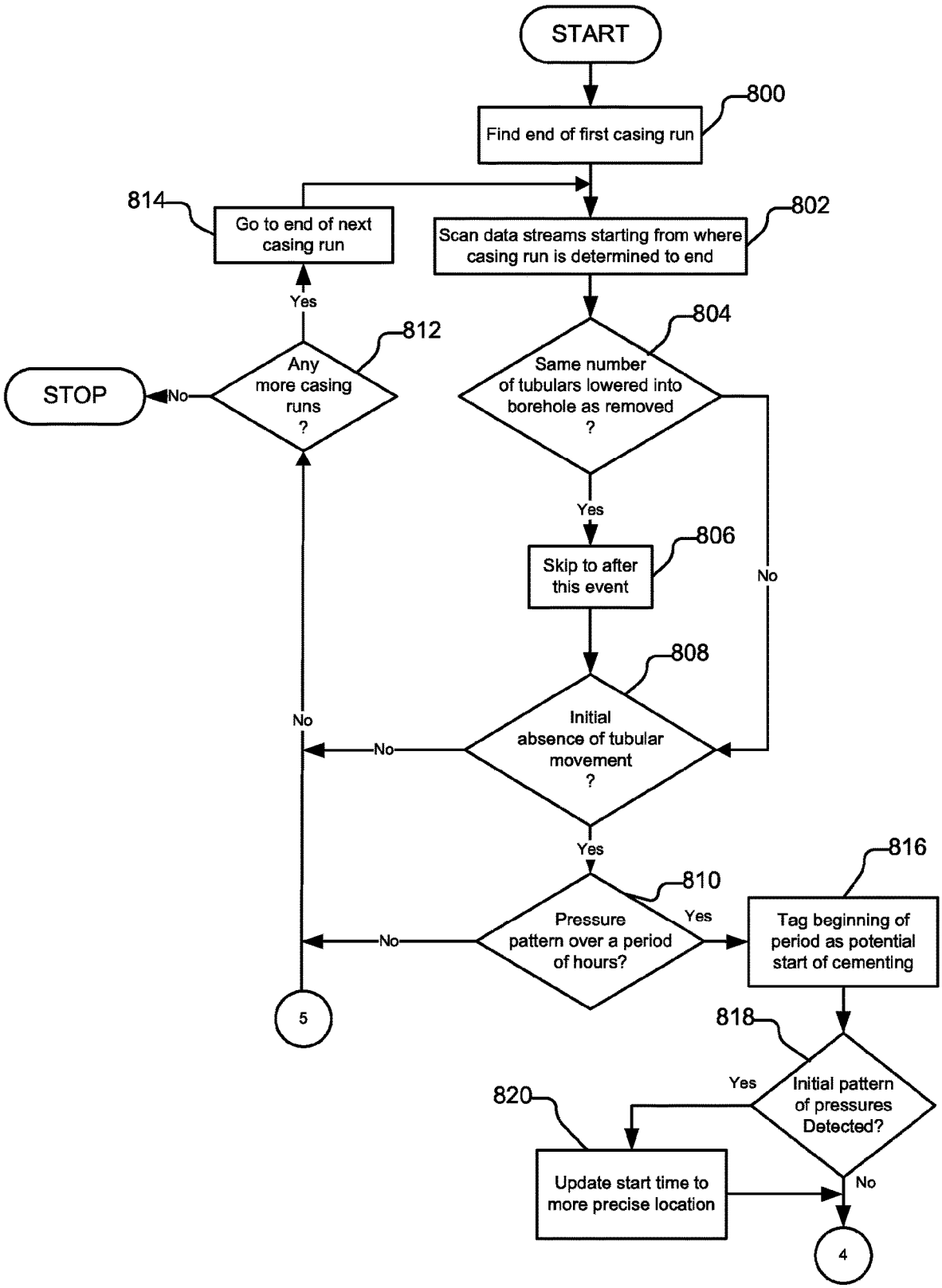
FIG. 12 is a flow diagram of a first part of a method of identifying cementing of a borehole constituting yet another embodiment of the invention.
Figure 13:
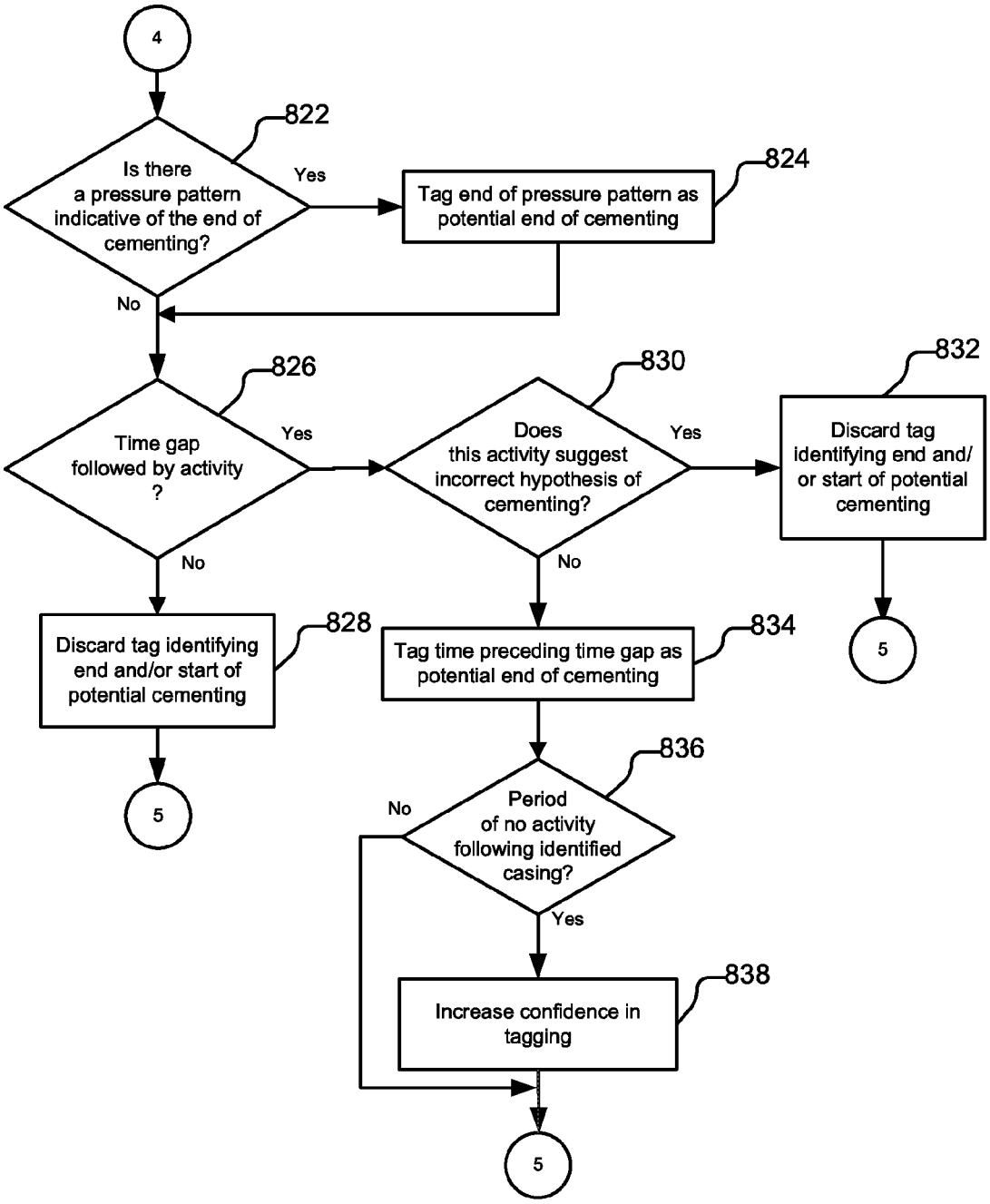
FIG. 13 is a flow diagram of a second part of the method of identifying cementing of the borehole of FIG. 11.

Referring to FIGS. 12 and 13, in order to determine whether cementing is in progress or even in the case of post-processing analysis to determine where cementing has begun in time and where in time cementing has been completed, analysis of output data from a cement pump sensor (not shown) is the simplest way to establish whether and when cementing has taken place. However, if the output from the cement pump sensor is not available, it is nevertheless possible to detect cementing by making inferences from the surface-side sensor data available. In this respect, the cementing detection apparatus makes use of the processing of the casing deployment detection apparatus described above in order to determine (Step 800) the end of a casing run.

Once the end of the casing run has been identified, the time window controller 418 is initially set to the point in time corresponding to the end of the casing run in order to set a forward analysis point in time. In this regard, the processing supervisor 416 analyzes (Step 802) sensor data available starting from the forward analysis point set. In some circumstances, a drillstring is tripped into the casing and then tripped out for conditioning or other purposes. In order to detect this activity, the processing supervisor 416 obtains block position sensor data from the block position calculator pertaining to a count of the number of tubulars lowered into the borehole 104 and another count of the number of tubulars removed from the borehole 104. If the results of the two counts is substantially the same (Step 804), then this may be indicative of the drillstring being run down the newly deployed casing and so the processing supervisor 416 instructs the time window controller 418 to advance (Step 806) the forward analysis point in time to the time corresponding to the end of the removal of the drillstring from the borehole 104.

The processing supervisor 416 then analyzes the sensor data in order to determine (Step 808) whether any further tubular movement is taking place within any appropriately short time range immediately following the forward analysis point in time. This analysis is reached earlier in the processing in the event that no run down the newly deployed casing is detected as a precursor to cementing. In any event, if no subsequent tubular activity is identified in the time range following the forward analysis point in time, the processing supervisor 416 seeks to identify (Step 810) pressure patterns using pressure sensor data obtained from the pressure calculation unit 412.

In this respect, during cementing it is known that pressure tests are performed. Moreover, cementing is a process that takes place over a number of hours. As such, the processing supervisor 416 instructs the signal pattern recognition engine unit 420 to try to identify a pattern of pressures over a testing period of hours in duration, for example pressure patterns indicative of the performance of pressure tests over the duration of a cementing operation. In this respect, a cementing operation can, for example, last anywhere between about 10 hours and about 50 hours. However, the amount of time required to complete a casing operation depends upon a number of parameters, including for example the consolidation of the formations, depth, borehole diameter, cement additives employed.

In the event that the pressure pattern is not found, or if subsequent tubular activity is identified in the time range following the forward analysis point in time (Step 808), then it is assumed that the end of the casing run has not been found and the processing supervisor 416 attempts to find other recorded casing deployments (Step 812) as points of reference for discovering cementing of casings. In this respect, if no further casing runs are stored, then the processing supervisor 416 ceases identification of the cementing operation. However, if other casing runs are stored, the processing supervisor 416 advances (Step 814) to the next time window and the above analysis is performed (Steps 800 to 810) in respect of the next detected casing deployment stored.

If the pressure pattern over the duration of hours is found, the point in time corresponding to the forward analysis point in time is recorded or tagged (Step 816) by the processing supervisor 416 as corresponding to the beginning of the cementing operation. Thereafter, the processing supervisor 416 instructs the signal pattern recognition engine 420 to try to detect (Step 818) an initial pattern of pressures, using data obtained from the pressure calculation unit 412, indicative of release of plugs to allow the cement to flow. If the initial pattern of pressures is detected, the processing supervisor 416 instructs the time window controller 418 to update the forward analysis point in time to correspond with a time in respect of which the initial pattern of pressures commences and the processing supervisor 416 tags (Step 820) the update forward analysis point as corresponding to the beginning of the cementing operation.

Turning to FIG. 13, the processing supervisor 416 then instructs the signal pattern recognition engine unit 420 to seek (Step 822) pressure patterns indicative of the end of the cementing operation. If such a pattern of pressures is found by the signal pattern recognition engine unit 420, the point in time corresponding to the point in time found to correspond to the end of cementing is tagged (Step 824) by the processing supervisor 416 as corresponding to the end of the cementing operation. Thereafter, or if such a pressure pattern indicative of the end of cementing cannot be found, the processing supervisor 416 nevertheless analyzes the sensor signals in order to determine (Step 826) whether, following the point in time determined to correspond to the end of the cementing operation, there is a period of time greater than a predetermined inactivity time period during which there is no activity followed by non-cementing activity, which could be indicative of an end to a cementing operation.

In this regard, during the period when cementing is meant to take place and/or shortly after the point in time recorded as the end of the cementing when the cement is meant to be setting, if activity is not detected after a cement setting time, then this is indicative that the time(s) identified as the end and/or beginning of the cementing operation has been incorrectly identified and the processing supervisor 416 discards (Step 828) the tags identifying the end and/or beginning of the cementing operation. However, if activity is detected, the processing supervisor 416 attempts to establish (Step 830) whether the activity is incompatible with the notion that the activity was preceded by a cementing operation.

For example, if the signal pattern recognition engine unit 420 identifies a hookload pattern indicative of a set of drill pipes being removed from the wellbore 104, following a detected potential cementing operation, such activity is clearly incompatible with the cementing operation and so the detection is most probably false. In this respect, in the event that the activity is indicative of an incorrect identification of cementing, then the processing supervisor 416 discards (Step 832) the tags identifying the end and/or beginning of the cementing. Otherwise, the processing supervisor 416 tags (Step 834) the point in time corresponding to the beginning of the activity as indicative of the end of the cementing operation.

The processing supervisor 416 also analyzes the sensor data in order to identify (Step 836) a prolonged period of inactivity following the end of the detected casing run. In such circumstances, the existence of the prolonged period of time provides an increased confidence (Step 838) in the detection of a cementing operation, because the period of inactivity is most likely to correspond to a period during which cementing resources are awaited at the rig 116.

Following tagging or discarding of tagging (Steps 828 and 834), the processing supervisor 416 attempts to find other recorded casing deployments (Step 812) as points of reference for discovering cementing of casings. In this respect, if no further casing runs are stored, then as mentioned above the processing supervisor 416 ceases identification of the cementing. However, if other casing runs are stored, the processing supervisor 416 advances (Step 814) to the next time window and the above analysis is performed (Steps 800 to 838) in respect of the next time casing run stored. Where events, for example beginnings and end of cementing operations are detected, the processing supervisor 416 provides the parameters, for example start and/or end times of the detected cementing operation at the data output 422 thereof, the parameter(s) being used by the GUI 235 to identify where (in time) the cementing operation is determined to begin and end.

Figure 14:
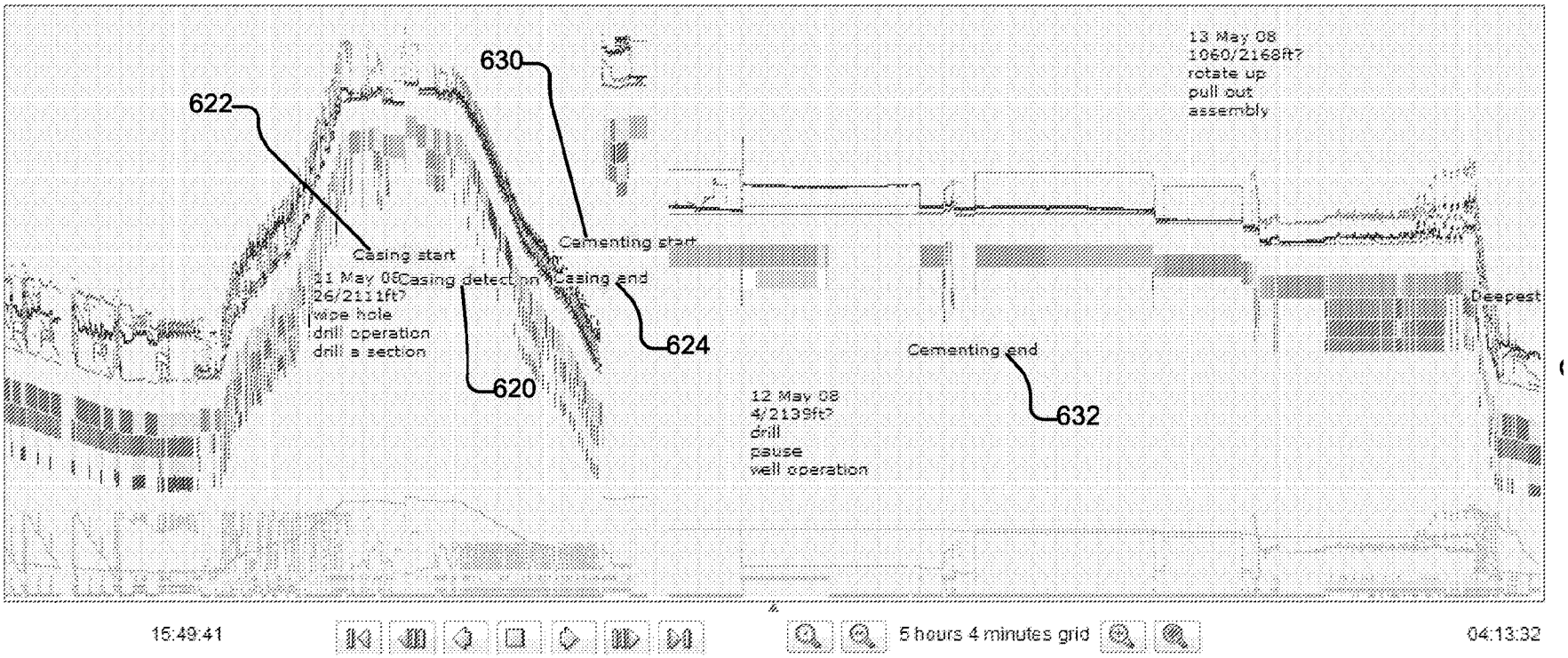
FIG. 14 is another screen shot of the graphical user interface of FIG. 8 generated with the assistance of the method of FIGS. 11 and 12.

In this regard, referring to FIGS. 11 and 14, the commencement of cementing 630 is indicated by the GUI 235 using the data obtained via the data output 422. Similarly, the end of the casing run 632 is also indicated by the GUI 235 using the data obtained via the data output 422.

It will be understood that this disclosure provides many different embodiments, or examples, for implementing different features of various embodiments. Specific examples of components and arrangements are described herein to simplify the present disclosure. These are, of course, merely examples and are not intended to be limiting.

Although a system with a Kelly and rotary table is shown in FIG. 1, those of skill in the art will recognize that the examples set forth herein are also applicable to so-called top drive drilling arrangements. Although the drilling system is shown in FIG. 1 as being on land, those of skill in the art will recognize that the examples set forth herein are equally applicable to marine environments.

In accordance with the present disclosure, a well site with associated wellbore and apparatus is described in order to describe an embodiment of the application. To that end, an apparatus at the well site can be altered due to field considerations encountered.

It is to be understood that the various embodiments and examples described herein, although different, are not necessarily mutually exclusive. For example, a particular feature, structure, or characteristic described herein in connection with one embodiment may be implemented within other embodiments without departing from the scope of the invention. In addition, it is to be understood that the location or arrangement of individual elements within each disclosed embodiment may be modified without departing from the spirit and scope of the invention. The following detailed description is, therefore, not to be taken in a limiting sense, and the scope of the present invention is defined only by the appended claims, appropriately interpreted, along with the full range of equivalents to which the claims are entitled.

It should also be noted that in the development of any such actual embodiment, numerous decisions specific to circumstance must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In this disclosure, the term "storage unit" may represent one or more devices for storing data, including read only memory (ROM), random access memory (RAM), magnetic RAM, core memory, magnetic disk storage mediums, optical storage mediums, flash memory devices and/or other machine readable mediums for storing information. The term "computer-readable medium" includes, but is not limited to portable or fixed storage devices, optical storage devices, wireless channels and various other mediums capable of storing, containing or carrying instruction(s) and/or data.

Embodiments described herein provide an apparatus and method, inter alia, of detecting deployment of casing in a borehole. In this regard, the apparatus and method can be varied to support optional analysis that can be used to confirm further the detection of casing in the borehole. For example, average weight can be calculated for tubulars and can be used to distinguish between drill pipes and casing pipes. In this respect, during tripping in or drilling, the hookload calculation unit 400 can be used to determine an average hookload value associated with the drillstring. Then, in relation to a candidate casing operation, the average hookload weight of the tubular being lowered into the borehole 104 can be calculated. The average hookload can be calculated using the following expression:

$$HKLD_{avg} = \frac{\sum_{i=1}^{N} (HKLD_{i+1} - HKLD_i)}{N}$$

where $HKLD_{avg}$ is average hookload, i is a counter variable, N is the total number of tubulars being summed, $HKLD_{i+1}$ is a current hookload, and $HKLD_i$ is a preceding hookload. Where possible, the calculation of the average hookload can be commenced from the spud stage of operations. However, if sensor data does not extend this far back in time, the average can nevertheless be calculated from when sensor data is reliably available. The use of the average hookload value mitigates the effects of casing pipes being cut.

The above technique can also be applied in order to calculate an average tubular length for both drill pipe and casing pipe. In such circumstances, the expression for average hookload is modified by replacing hookloads with lengths, and such a calculation can be performed by the block position calculation unit 404.

In another example, where runs of tubular down the borehole 104 are detected, in some circumstances, this may be attributable to the deposition of a so-called cement plug in the borehole 104 in order, for example, to isolate a "troubled" zone of the borehole 104. In order to distinguish between this activity and a liner run or a casing run, the difference in the amount of tubular tripped in is compared with the amount of tubular tripped out. However, where the amount of tubular tripped in is substantially the same as the amount of tubular tripped out, the processing supervisor 416 can be arranged to establish whether pressure peaks, indicative of testing during cementing, is absent. In the absence of the detection of the pressure peaks, the processing supervisor 416 can infer that cementing is not taking place and so deposition of the cement plug is therefore taking place.

What is claimed is:

1. A method of identifying deployment of casing in a borehole, the method comprising:

using one or more sensors to measure at least one of properties of the borehole or equipment being used to construct the borehole;

receiving first sensor data from at least one of the one or more sensors corresponding to a first time-varying sensor signal;

receiving second sensor data from at least one of the one or more sensors corresponding to a second time-varying sensor signal;

determining an in-slips event based on a first characteristic of the first sensor data matching a first expected characteristic, the in-slips event being at a first time;

in response to determining the in-slips event, identifying a candidate casing time window that follows the first time for a duration;

determining one or more second characteristics that distinguish a casing deployment operation from one or more other operations, the one or more second characteristics being determined based on the second time-varying sensor signal during the candidate casing time window, wherein the one or more second characteristics comprise a length of a tubular element deployed into the borehole during the candidate casing time window; and in response to determining the one or more second characteristics, determining one or more third characteristics based on third sensor data from at least one of the one or more sensors taken during the candidate casing time window, wherein the one or more third characteristics further distinguish the casing deployment operation from one or more other operations and increase a confidence that the casing deployment operation occurs during the candidate casing time window; and identifying deployment of casing in the borehole in the candidate casing time window based on the first characteristic, the one or more second characteristics, and the one or more third characteristics.

2. The method according to claim 1, further comprising:

communicating the identification of deployment of casing in the borehole to a controller; and controlling the equipment to construct the borehole.

3. The method according to claim 2, wherein controlling the equipment to construct the borehole comprises controlling the equipment to perform casing operations in response to identifying deployment of casing, and controlling the equipment to perform drilling operations when deployment of casing is not identified.

4. The method according to claim 1, further comprising:

generating the first time-varying sensor signal top-side surface; and generating the second time-varying sensor signal top-side surface.

5. The method according to claim 1, further comprising:

identifying a correlation between the first characteristic of the first sensor data and the first expected characteristic of the first sensor data; and determining whether at least one of the one or more second characteristics is quantifiably substantially the same as the second expected characteristic of the second sensor data.

6. The method according to claim 1, wherein the first sensor data comprises hookload data, and wherein the second sensor data comprises block position data.

7. The method according to claim 1, wherein identifying deployment of casing in the candidate time window comprises graphically labeling the candidate casing time window in a visualization of at least the first and second sensor data.

8. The method according to claim 7, wherein determining the one or more second characteristics comprises determining whether the length of the tubular element corresponds to a known length of a standard casing tubular.

9. The method according to claim 8, further comprising:

analyzing the first sensor data in respect of the candidate casing time window in order to identify a predetermined repeating pattern including the first expected characteristic of the first sensor data.

10. The method according to claim 9, wherein the repeating pattern comprises a predetermined number of repeats, or wherein the repeating pattern comprises an increasing magnitude between repeats.

11. The method according to claim 10, further comprising:

using the first sensor data to determine a weight of the tubular element contributing to the repeating pattern; and modifying the predetermined number of repeats in response to the weight of the tubular corresponding to a known weight of the standard casing tubular.

12. The method according to claim 9, further comprising:

receiving third sensor data corresponding to a third time-varying sensor signal.

13. The method according to claim 12, wherein the third sensor data comprises magnitude data;

the method further comprising:

evaluating a magnitude of the magnitude data with respect to a predetermined reference magnitude value.

14. The method according to claim 13, wherein:

the evaluation of the magnitude of the magnitude data includes determining whether the magnitude is less than the predetermined reference magnitude value; and the method further comprises recording parameters of the candidate casing time window for further analysis in response to the evaluation of the magnitude being indicative of deployment of casing in the borehole during the candidate casing time window.

15. The method according to claim 13, further comprising:

receiving fourth sensor data corresponding to a fourth time-varying sensor signal from the one or more sensors;

identifying a pattern described by the first, third and fourth sensor data in the candidate casing time window indicative of an inserted casing overcoming an obstruction in the borehole; and analyzing the first sensor signal, the second sensor signal, the third sensor signal, the fourth sensor signal, or a combination thereof, in respect of the candidate casing time window in order to identify an indicator in the first, second, third, or fourth sensor signals, or a combination thereof, indicative of deployment of casing in the borehole.

16. The method according to claim 7, further comprising:

identifying time periods when slips events are employed; and analyzing the second sensor data in respect of the candidate casing time window in order to identify an indicator, the indicator comprising insertion of at least a predetermined number of tubulars into the borehole without off-slips events therebetween.

17. The method of claim 1, wherein determining the one or more third characteristics comprises determining a torque applied to the tubular.

18. The method of claim 17, wherein determining the one or more second characteristics comprises determining that there is a hookload pattern showing a repetition of the length of the tubular.

19. The method of claim 18, wherein determining the one or more third characteristics comprises:

determining that the torque applied to the tubular is above a threshold; and in response to determining that the torque is above the threshold, analyzing a combination of two or more of the torque, a pressure, and the hookload pattern to determine if a transient obstacle-encounter event occurred during the candidate casing time window, wherein the candidate casing time window is discarded when the analysis indicates the transient obstacle-encounter did not occur.

20. The method of claim 1, further comprising, in response to determining the one or more third characteristics:

determining a number of tubulars joined together during the candidate casing time window with no off-slips events between connections;

identifying peaks in pressure data collected during the candidate casing time window;

comparing a hookload value collected during the candidate casing time window to a threshold hookload value, in response to identifying peaks in the pressure data;

when the hookload value is above the threshold value, determining that the casing deployment operation did not occur in the candidate casing time window; and when the hookload value is not above the threshold value:

analyzing hookload and pressure data to determine if, during the candidate casing time window, a drillstring was passed into an uncased open region beneath a casing and then drilling commenced; and determining that the casing deployment operation did not occur in the candidate casing time window when the analyzing of the hookload and pressure data indicates that the drillstring was passed into the uncased open region beneath the casing and then drilling comments.

21. A casing deployment detection apparatus comprising:

a plurality of sensors for measuring data relating to a borehole in which casing is being deployed or for measuring a system for constructing the borehole, or for measuring both;

a processing resource arranged to support a signal pattern recognition engine unit and a block position calculation unit;

a first sensor input operably coupled to the signal pattern recognition engine unit and arranged to receive, when in use, first sensor data corresponding to a first time-varying sensor signal;

a second sensor input operably coupled to a tubular measurement unit and arranged to receive, when in use, second sensor data corresponding to a second time-varying sensor signal;

wherein the signal pattern recognition engine unit is arranged to analyze a characteristic of the first sensor data associated with deployment of the casing in the borehole; and wherein the block position calculation unit is arranged to analyze a characteristic of the second sensor data associated with the deployment of the casing in the borehole; and wherein the processing resource is configured to perform operations, the operations comprising:

determining an in-slips event based on a first characteristic of the first sensor data matching a first expected characteristic, the in-slips event being at a first time;

in response to determining the in-slips event, identifying a candidate casing time window that follows the first time for a duration;

determining one or more second characteristics that distinguish a casing deployment operation from one or more other operations, the one or more second characteristics being determined based on the second time-varying sensor signal during the candidate casing time window, wherein the one or more second characteristics comprise a length of a tubular element deployed into the borehole during the candidate casing time window; and in response to determining the one or more second characteristics, determining one or more third characteristics based on third sensor data from at least one of the one or more sensors taken during the candidate casing time window, wherein the one or more third characteristics further distinguish the casing deployment operation from one or more other operations and increase a confidence that the casing deployment operation occurs during the candidate casing time window; and identifying deployment of casing in the borehole in the candidate casing time window based on the first characteristic, the one or more second characteristics, and the third characteristic.

22. The apparatus according to claim 21, wherein the processing resource is arranged to identify a candidate casing time window corresponding to the determined deployment of the casing in the borehole and to support a torque calculation unit, the apparatus further comprising:

a third sensor input operably coupled to the torque calculation unit and arranged to receive, when in use, third data corresponding to a third time-varying sensor signal; and the torque calculation unit is arranged to use the third sensor data in respect of the candidate casing time window to increase confidence in the determination of the deployment of the casing in the borehole.

23. The apparatus according to claim 22, wherein the processing resource is arranged to support a pressure calculation unit, the apparatus further comprising:

a fourth sensor input operably coupled to the pressure calculation unit and arranged to receive, when in use, fourth sensor data corresponding to a fourth time-varying sensor signal; and the signal pattern recognition engine unit is arranged to identify a pattern described by the first, third and fourth sensor data in respect of the candidate casing time window indicative of an inserted casing overcoming an obstruction in the borehole.

24. The apparatus according to claim 22, wherein the processing resource is arranged to identify time periods when slips events are employed and provide, when in use, slips state data to the signal pattern recognition engine unit;

the signal pattern recognition engine unit is arranged to analyze the second sensor data in respect of the candidate casing time window in order to identify an indicator indicative of casing deployment, the indicator comprising insertion of at least a predetermined number of tubulars into the borehole without off-slips events therebetween;

the processing resource is arranged to support a pressure calculation unit, the apparatus further comprising:

a fourth sensor input operably coupled to the pressure calculation unit and arranged to receive, when in use, fourth sensor data corresponding to a fourth time-varying sensor signal; and the pressure calculation unit is arranged to analyze the fourth sensor data in respect of the candidate casing time window in order to identify another indicator that the casing has in fact been deployed in the borehole.

* * * * *